US009801771B2

(12) United States Patent
Schuerch, Jr.

(10) Patent No.: US 9,801,771 B2
(45) Date of Patent: Oct. 31, 2017

(54) ADJUSTABLE POSITION LIMB SUPPORT FOR SURGICAL TABLES

(71) Applicant: Peter E. Schuerch, Jr., Quincy, MA (US)

(72) Inventor: Peter E. Schuerch, Jr., Quincy, MA (US)

( * ) Notice: Subject to any disclaimer, the term of this patent is extended or adjusted under 35 U.S.C. 154(b) by 613 days.

(21) Appl. No.: 14/056,857

(22) Filed: Oct. 17, 2013

(65) Prior Publication Data

US 2014/0101851 A1 Apr. 17, 2014

Related U.S. Application Data

(60) Provisional application No. 61/715,028, filed on Oct. 17, 2012.

(51) Int. Cl.
*A61G 13/12* (2006.01)
*A61G 13/10* (2006.01)

(52) U.S. Cl.
CPC ..... *A61G 13/1245* (2013.01); *A61G 13/101* (2013.01); *A61G 13/125* (2013.01); *A61G 13/1205* (2013.01)

(58) Field of Classification Search
CPC ..... A61G 13/0036; A61G 13/0063; A61G 13/128; A61G 13/1245; A61G 13/125; A61G 13/1205; A61G 13/101
USPC ..... 248/230.3, 229.12, 286.1, 218.4, 214
See application file for complete search history.

(56) References Cited

U.S. PATENT DOCUMENTS

| | | | |
|---|---|---|---|
| 333,220 | A | 12/1885 | Hildebrand |
| 357,694 | A | 2/1887 | Klein |
| 358,513 | A | 3/1887 | Walton |
| 541,863 | A | 7/1895 | Loomis |

(Continued)

FOREIGN PATENT DOCUMENTS

| | | |
|---|---|---|
| CN | 201870867 | 6/2011 |
| GB | 743130 | 1/1956 |

OTHER PUBLICATIONS

Trimano Support Arm, 2011, Arthrex GmbH.
Arthroscopy Limb Positioners, Limb Positioners for Hip, Knee, Distal Extremities and Shoulder, 2013, Arthrex Inc.

*Primary Examiner* — Kari Rodriquez
*Assistant Examiner* — Kari Petrik
(74) *Attorney, Agent, or Firm* — Pandiscio & Pandiscio

(57) ABSTRACT

A limb holder comprising:
a mounting bracket for attachment to a surgical table;
a mounting element comprising a spheroidal surface for attachment to said mounting bracket;
a clamping assembly for providing a clamping engagement about said spheroidal surface of said mounting element, said clamping assembly comprising an upper jaw and a lower jaw, wherein said upper jaw and said lower jaw are biased towards one another so as to provide said clamping engagement about said sphereoidal surface of said mounting element;
a limb support element mounted to said clamping assembly via a support rod; and
a release mechanism mounted to said support rod and connected to said clamping assembly for selectively releasing said clamping engagement of said clamping assembly about said sphereoidal surface of said mounting element, whereby to allow said limb support ele-
(Continued)

ment to be repositioned relative to said mounting element and hence repositioned relative to the surgical table.

9 Claims, 29 Drawing Sheets

(56) References Cited

U.S. PATENT DOCUMENTS

| | | | | |
|---|---|---|---|---|
| 548,024 | A | 10/1895 | Adams | |
| 979,091 | A | 12/1910 | Pickart | |
| 1,697,121 | A | 1/1929 | Knebel | |
| 1,858,144 | A | 5/1932 | Fariello | |
| 1,894,739 | A | 1/1933 | Gilbert | |
| 1,919,908 | A | 7/1933 | Schmidt et al. | |
| 2,898,068 | A | 8/1959 | Warren | |
| 3,046,072 | A | 7/1962 | Douglass, Jr. et al. | |
| 3,452,978 | A | 7/1969 | Creelman | |
| 3,810,462 | A | 5/1974 | Szpur | |
| 3,817,512 | A | 6/1974 | Torrey | |
| 4,034,574 | A | 7/1977 | Kuder | |
| 4,308,419 | A | 12/1981 | Fredriksson | |
| 4,426,071 | A | 1/1984 | Klevstad | |
| 4,564,179 | A | 1/1986 | Hollingsworth | |
| 5,369,827 | A | 12/1994 | Parke et al. | |
| 5,544,968 | A | 8/1996 | Goellner | |
| 5,571,072 | A | 11/1996 | Kronner | |
| 5,597,146 | A | 1/1997 | Putrnah | |
| 5,775,334 | A | 7/1998 | Lamb et al. | |
| 5,802,641 | A | 9/1998 | Van Steenburg | |
| 5,961,085 | A * | 10/1999 | Navarro | A47C 16/00 128/878 |
| 5,961,512 | A | 10/1999 | Purnell | |
| 6,058,534 | A | 5/2000 | Navarro et al. | |
| 6,622,980 | B2 | 9/2003 | Boucher et al. | |
| 6,663,055 | B2 * | 12/2003 | Boucher | A61G 13/12 248/118 |
| 7,171,709 | B2 | 2/2007 | Weismitler | |
| 7,243,654 | B2 | 7/2007 | Schuerch | |
| RE41,412 | E | 7/2010 | Van Steenburg | |
| 9,333,142 | B2 | 5/2016 | Schuerch, Jr. | |
| 2004/0143243 | A1 | 7/2004 | Wahrburg | |
| 2008/0121765 | A1 | 5/2008 | Fetzer | |
| 2008/0215065 | A1 | 9/2008 | Wang et al. | |
| 2009/0236484 | A1 | 9/2009 | Koch et al. | |
| 2010/0030377 | A1 | 2/2010 | Unsworth | |
| 2012/0010629 | A1 | 1/2012 | Mire et al. | |
| 2012/0174318 | A1 | 7/2012 | Vestergaard | |
| 2012/0197182 | A1 | 8/2012 | Millman et al. | |
| 2012/0209291 | A1 | 8/2012 | Anderson et al. | |
| 2012/0253513 | A1 | 10/2012 | Unsworth | |

* cited by examiner

ADJUSTABLE POSITION LIMB SUPPORT FOR SURGICAL TABLES

REFERENCE TO PENDING PRIOR PATENT APPLICATION

This patent application claims benefit of prior U.S. Provisional Patent Application Ser. No. 61/715,028, filed Oct. 17, 2012 by Peter Schuerch, Jr. for ADJUSTABLE POSITION LIMB SUPPORT FOR SURGICAL TABLES, which patent application is hereby incorporated herein by reference.

FIELD OF THE INVENTION

This invention relates to medical devices in general, and more particularly to adjustable position limb supports for attachment to surgical tables for positioning and supporting a patient's limb.

BACKGROUND OF THE INVENTION

Patients undergoing a gynecologic, urologic or laparoscopic procedure must generally be properly positioned in order for the physician to carry out the procedure with maximum benefit. Properly positioning a patient for such a procedure typically requires that the patient lay in the supine position, with their knees raised up to varying degrees. This is known as the lithotomy position.

During the gynecologic, urologic or laparoscopic procedure, it is common for the lower legs of the patient to be supported in the desired position by a pair of leg stirrups.

Leg stirrups of the kind typically used for gynecologic, urologic or laparoscopic procedures are well known in the art. Such leg stirrups typically comprise an adjustable attachment mechanism at the proximal end of the stirrup which is configured to attach the stirrup to a surgical table, a support member extending distally away from the attachment mechanism (generally along the line of the patient's leg), and a padded "boot" section, configured to partially surround the calves and feet of a patient, slidably mounted to the support member so as to provide a comfortable contact or support surface for the patient's calves and heel. This padded boot section also serves to reduce or eliminate pressure on various nerves in the patient's leg, thereby further increasing patient comfort.

As noted above, a patient undergoing a gynecologic, urologic and/or laparoscopic procedure is typically put in the lithotomy position, with knees raised up to varying degrees. During the course of the procedure, it may be expedient or necessary for the physician to alter the position or orientation of the patient's leg(s). Such alteration requires the adjustment of the adjustable attachment mechanism located at the proximal end of the leg stirrup(s) proximate the patient's hip joint(s).

Early versions of such leg stirrups required the physician to adjust the position of the leg stirrups by direct manipulation of the adjustable attachment mechanism, which is located at the proximal end of the leg stirrup and hence quite close to the procedure site (e.g., in and around the patient's pelvic area). However, the adjustment of the leg stirrup at that location can be inconvenient for the physician, since the physician is typically located at the distal end of the leg stirrup. Accordingly, more recent versions of leg stirrups allow for the adjustment of the position of the leg stirrup by providing means at the distal end of the leg stirrup to manipulate the position of the leg stirrup.

These more recent versions of leg stirrups are still deficient, however, inasmuch as they fail to provide a full range of motion or adjustment for the patient's limb. For example, in some recent versions of leg stirrups, the stirrups may be adjusted only in the lithotomy (i.e., up and down) and abduction/adduction (i.e., side-to-side) directions, but do not allow adjustment in the supination/pronation direction. Also, the means to effect position adjustments on existing leg stirrups can be cumbersome to manipulate.

Accordingly, there is a need for an improved leg stirrup assembly wherein the position of the leg stirrup assembly may be easily adjusted at the distal end of the leg stirrup, and wherein the leg stirrup assembly may be moved in three distinct axes of rotation (i.e., lithotomy, abduction/adduction and supination/pronation), in a manner more like the natural motion of the human hip joint.

SUMMARY OF THE INVENTION

This invention comprises the provision and use of a stirrup-type leg holder of novel construction, independently adjustable in the lithotomy, abduction/adduction and supination/pronation dimensions, that is, along three distinct axes of rotation, through the action of a single control mechanism which may be located at the distal end of the leg stirrup.

In one preferred construction, the device comprises a means for attachment to a surgical table, to which is attached an element about which rotation may take place, and a means to control the amount of rotation in the three dimensions described.

A mechanism is provided which keeps the device in a locked position and, upon activation of a release mechanism, the device is free to move in any of the dimensions described, or in all three dimensions simultaneously.

The release mechanism is preferably operated by cable and may therefore be located anywhere on the device as desired, with the end distal to the proximally-located table attachment means being preferred for the location of the release mechanism, whereby to position at least a portion of the release mechanism at the distal end of the leg stirrup.

In one preferred form of the present invention, there is provided a stirrup-type leg holder which comprises a mounting bracket for attachment to a surgical table; a semi-ball for attachment to the mounting bracket; a clamping assembly comprising an upper jaw and a lower jaw for clamping engagement about the semi-ball; and a stirrup boot mounted to the clamping assembly via a support rod. A release mechanism is provided to selectively release the clamping assembly so as to allow the stirrup boot to be repositioned relative to the semi-ball (and hence repositioned relative to the surgical table). The release mechanism comprises an actuating mechanism (e.g., a handle and trigger) which controls a cam mechanism which can force the upper jaw and lower jaw apart, against the power of a spring, whereby to allow the upper jaw and lower jaw to rotate about the semi-ball, and hence allow the position of the stirrup boot to be adjusted relative to the surgical table. In one preferred construction, the semi-ball comprises an upper limiting pin and a lower limiting pin which cooperate with an upper limit surface on the upper jaw and a lower limit surface on the lower jaw to limit rotation of the upper and lower jaws about the semi-ball. A gas cylinder is also provided to assist in positioning the stirrup boot relative to the surgical table.

In another preferred form of the present invention, there is provided a limb holder comprising:

a mounting bracket for attachment to a surgical table;

a mounting element comprising a spheroidal surface for attachment to said mounting bracket;

a clamping assembly for providing a clamping engagement about said spheroidal surface of said mounting element, said clamping assembly comprising an upper jaw and a lower jaw, wherein said upper jaw and said lower jaw are biased towards one another so as to provide said clamping engagement about said sphereoidal surface of said mounting element;

a limb support element mounted to said clamping assembly via a support rod; and a release mechanism mounted to said support rod and connected to said clamping assembly for selectively releasing said clamping engagement of said clamping assembly about said sphereoidal surface of said mounting element, whereby to allow said limb support element to be repositioned relative to said mounting element and hence repositioned relative to the surgical table.

In another preferred form of the present invention, there is provided a method for supporting a limb adjacent to a surgical table, the method comprising:

providing a limb holder comprising:

a mounting bracket for attachment to a surgical table;

a mounting element comprising a spheroidal surface for attachment to said mounting bracket;

a clamping assembly for providing a clamping engagement about said spheroidal surface of said mounting element, said clamping assembly comprising an upper jaw and a lower jaw, wherein said upper jaw and said lower jaw are biased towards one another so as to provide said clamping engagement about said sphereoidal surface of said mounting element;

a limb support element mounted to said clamping assembly via a support rod; and a release mechanism mounted to said support rod and connected to said clamping assembly for selectively releasing said clamping engagement of said clamping assembly about said sphereoidal surface of said mounting element, whereby to allow said limb support element to be repositioned relative to said mounting element and hence repositioned relative to the surgical table; and utilizing the release mechanism to reposition said limb support element relative to said mounting element and hence relative to the surgical table.

BRIEF DESCRIPTION OF THE DRAWINGS

These and other objects and features of the present invention will be more fully disclosed or rendered obvious by the following detailed description of the preferred embodiments of the invention, which is to be considered together with the accompanying drawings wherein like numbers refer to like parts, and further wherein.

DETAILED DESCRIPTION OF THE PREFERRED EMBODIMENTS

Figure 1:
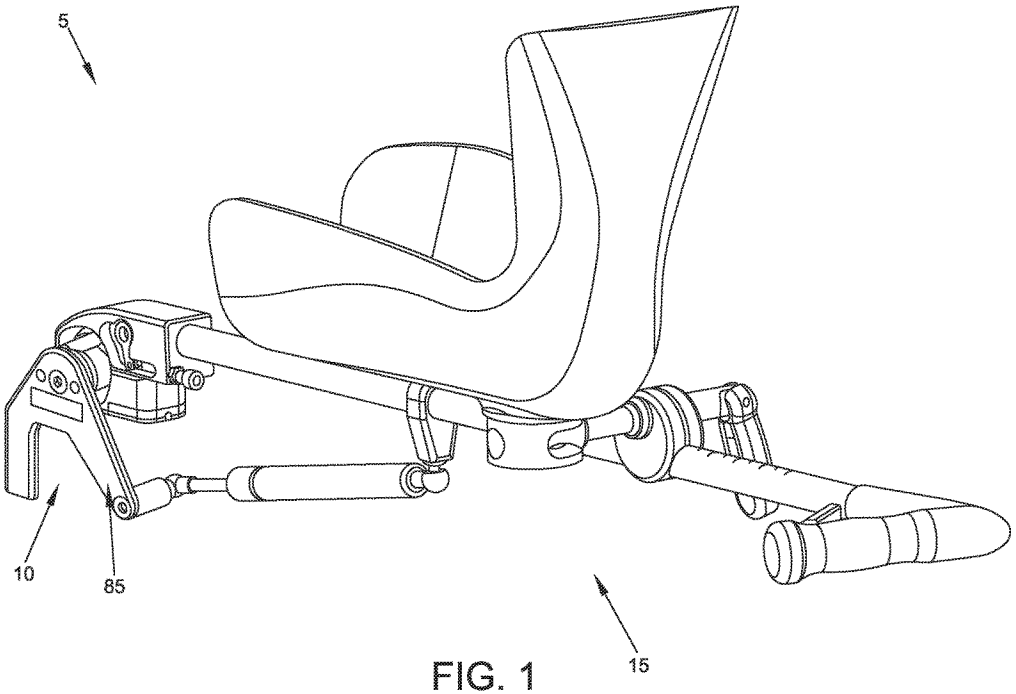
FIG. 1 is a schematic view of an adjustable leg holder formed in accordance with the present invention, wherein the cover of the adjustable leg holder has been removed to show internal structure.
Figure 2:
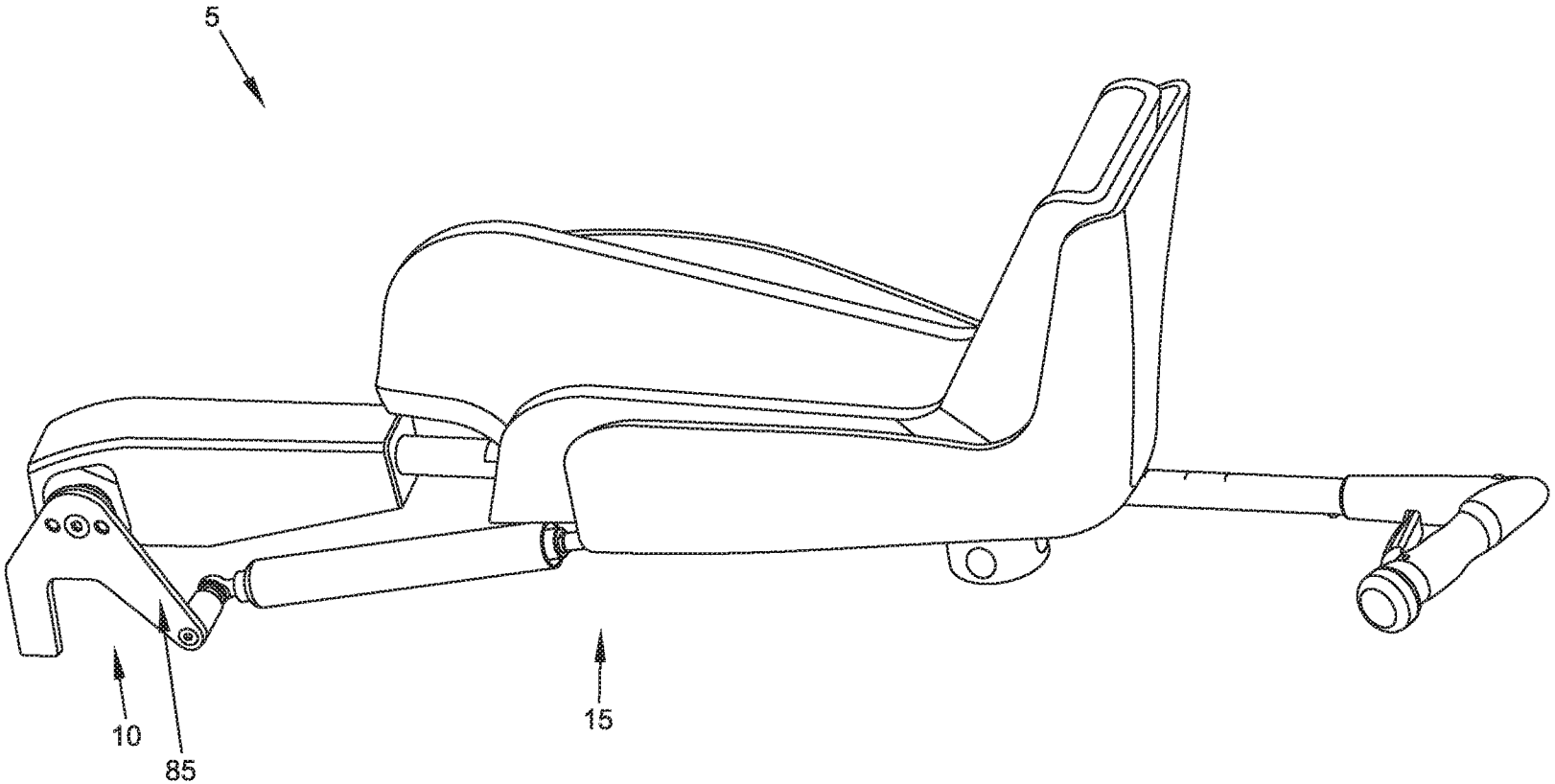
FIG. 2 is another schematic view of the adjustable leg holder shown in FIG. 1.
Figure 3:
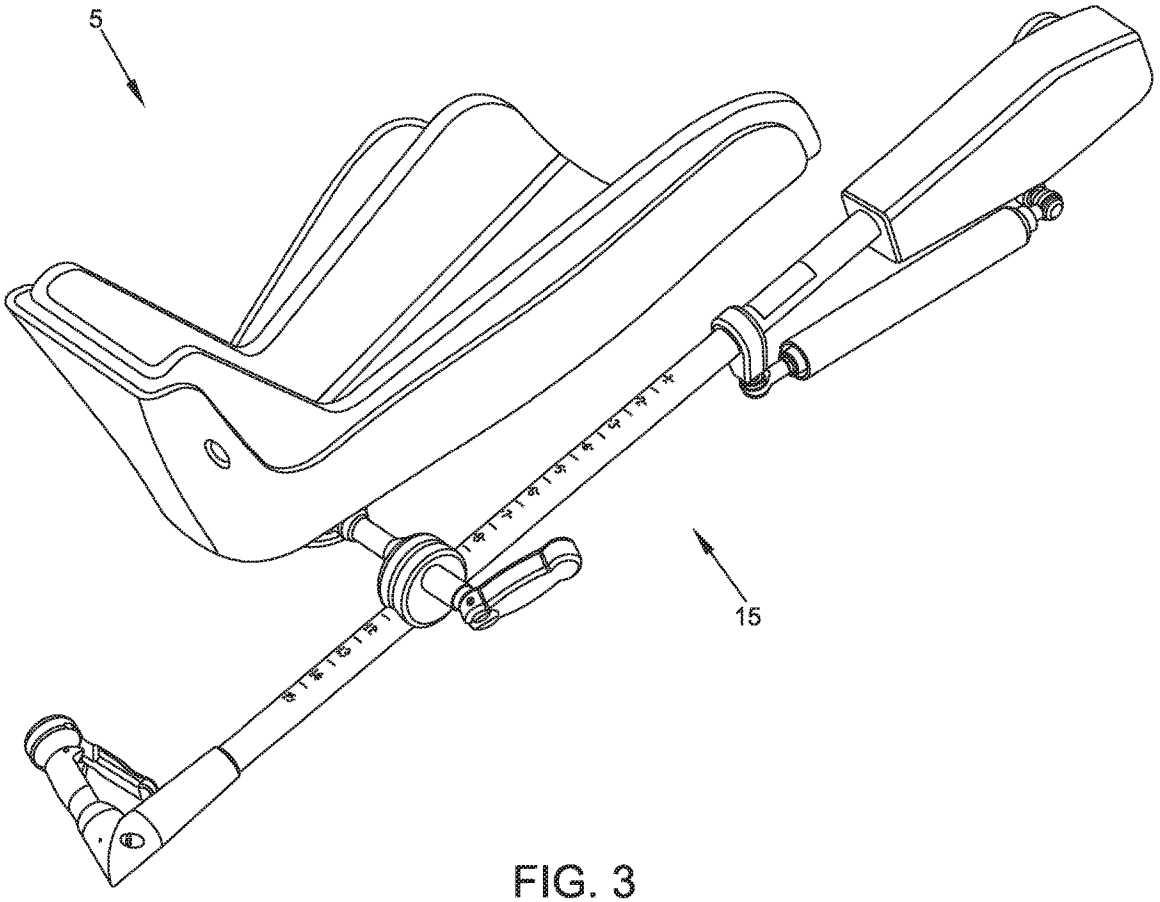
FIG. 3 is another schematic view of the adjustable leg holder shown in FIG. 1.

Looking first at FIGS. 1-3, there is shown a novel stirrup-type leg holder 5 formed in accordance with the present invention. Leg holder 5 is constructed so that it may be easily mounted to a surgical table and thereafter easily adjusted at the distal end of the leg stirrup in order to alter the position of the leg of a patient. More particularly, leg holder 5 generally comprises a mount assembly 10 for mounting leg holder 5 to a surgical table, and a leg support assembly 15 for supporting a patient's leg. Leg support assembly 15 is adjustably mounted to mount assembly 10 by a ball-and-socket arrangement as will hereinafter be discussed. As a result of this construction, a physician is able to move leg support assembly 15 along at least three (3) axes of rotation relative to mount assembly 10 (and hence relative to the surgical table). Consequently, in use, a physician is also able to move a patient's leg that is supported by leg support assembly 15 along at least three (3) axes of rotation relative to the surgical table.

Figure 4:
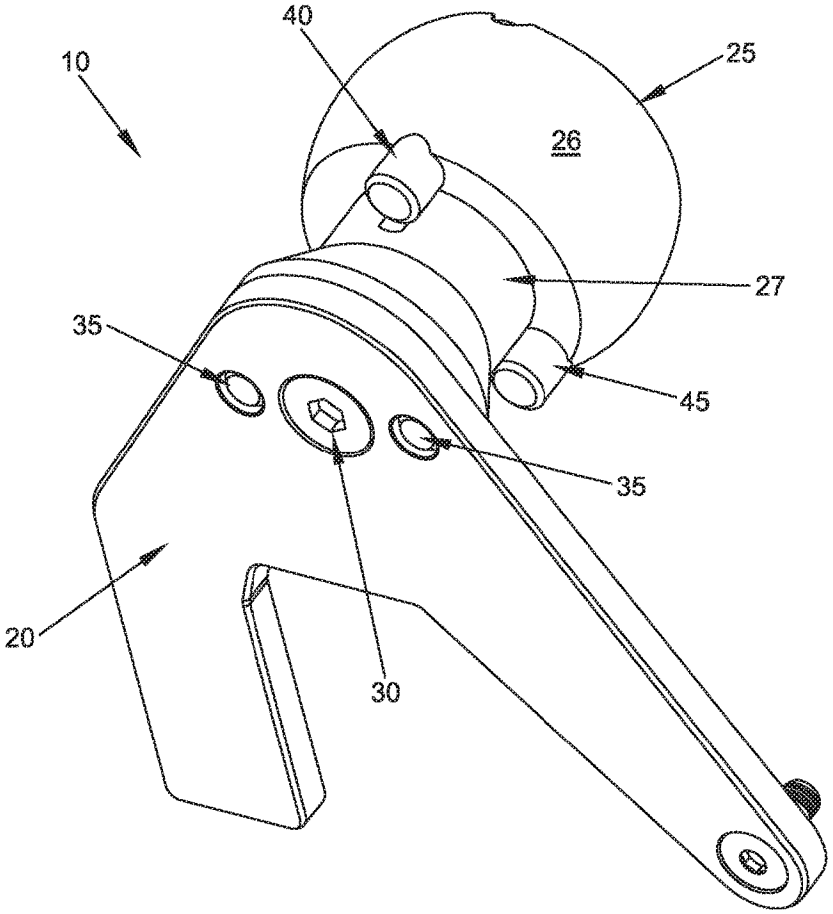
FIG. 4 is a schematic view of the mount assembly of the adjustable leg holder shown in FIG. 1.
Figure 5:
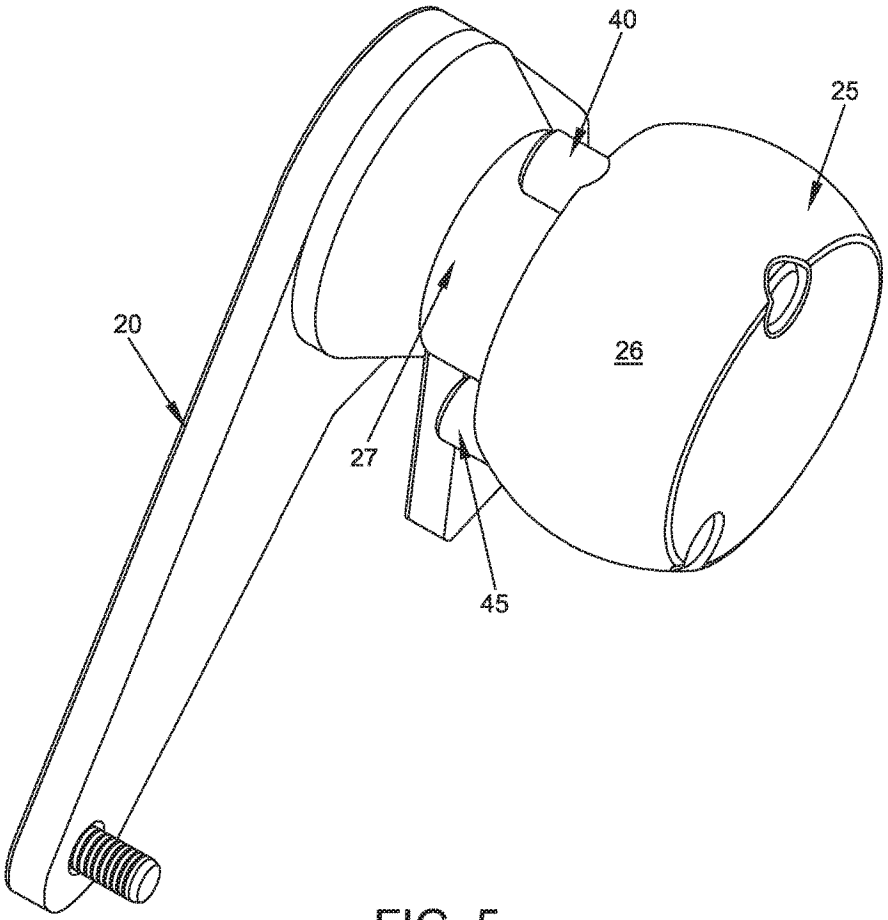
FIG. 5 is another schematic view of the mount assembly shown in FIG. 4.

In one preferred embodiment of the invention, and looking now at FIGS. 4 and 5, mount assembly 10 comprises a mounting bracket 20 and semi-ball 25. Semi-ball 25 comprises an outer surface 26 following a spheroidal geometry, and a neck 27 extending along the longitudinal axis of the semi-ball. Semi-ball 25 is fixedly attached to mounting bracket by a bolt 30 which extends into neck 27. Pegs 35 pass from neck 27 of semi-ball 25 into mounting bracket 20 so as to prevent rotation of semi-ball 25 with respect to mounting bracket 20. Semi-ball 25 also comprises an upper limiting pin 40 and a lower limiting pin 45 which limit the range of motion of leg support assembly 15 relative to mount assembly 10, as will hereinafter be discussed. Upper limiting pin 40 and lower limiting pin 45 extend parallel to neck 27.

Turning now to FIGS. 6-15, leg support assembly 15 generally comprises a support rod 50 having a proximal end and a distal end, a clamping assembly 55 mounted to the proximal end of support rod 50, and a handle 60 and an actuating element or lever 65 mounted to the distal end of support rod 50.

Leg support assembly 15 also comprises a stirrup boot 70 for receiving the lower leg and foot of a patient. Boot 70 may be mounted on slidable adjuster 75, which is itself slidably mounted on support rod 50 intermediate its proximal and distal ends. Slidable adjuster 75 allows boot 70 to be moved along the length of support rod 50 so as to accommodate the anatomy of differently-sized patients.

Leg support assembly 15 preferably also comprises a gas cylinder 80. The proximal end of gas cylinder 80 is mounted to distal leg 85 of mounting bracket 20 (FIGS. 1 and 2) and the distal end of gas cylinder 80 is mounted to a collar 90 which is fixedly mounted to support bar 50. The air pressure inside gas cylinder 80 is preferably set so as to approximately offset the combined weight of leg support assembly 15 and a patient's leg so as to render movement of the apparatus relatively easy during use. In the present device, gas cylinder 80 may also be used to limit the travel in the lithotomy dimension, in the sense that clamping assembly 55 can move in the high lithotomy direction until gas cylinder 80 reaches its full extension length and clamping assembly 55 can move in the low lithotomy dimension until it reaches its full compression length. Accordingly, the force exerted by gas cylinder 80 allows a physician to easily move leg support assembly 15 (with a patient's leg disposed thereon) with one hand during use.

Clamping Element

Looking now at FIGS. 8-17, clamping assembly 55 comprises an upper jaw 100, a lower jaw 105 and a bottom plate 110. Upper jaw 100 comprises a concave gripping surface 111 for engaging the spheroidal outer surface 26 of semi-ball 25, and lower jaw 105 comprises a concave gripping surface 112 for engaging the spheroidal outer surface 26 of semi-ball 25. A bore 115 and counter bore 116 extend through lower jaw 105. Bore 115 is of a first diameter near the top surface 120 of lower jaw 105 and counterbore 116 is of a second, larger diameter deep to top surface 120 of lower jaw 105. An annular shoulder 117 is disposed at the intersection of bore 115 and counterbore 116.

A cavity 125 that is coaxial with bore 115 and counterbore 116 extends into upper jaw 100 from the bottom surface 130 of upper jaw 100. A portion of cavity 125 is threaded so as to threadably engage the shaft of a spring compression bolt (see below).

A bore 135 and counterbore 136 extend through bottom plate 110. Bore 135 is of a first diameter from bottom surface 140 of bottom plate 110 until just below top surface 145 of bottom plate 110, and counterbore 136 is of a second, larger diameter. Bore 135 is threaded to engage a tension set screw (see below).

Upper jaw 100 and lower jaw 105 are joined together at one side of clamping assembly 55 by screws 150. Lower plate 110 is joined to lower jaw 105 by screws 155.

Figure 16:
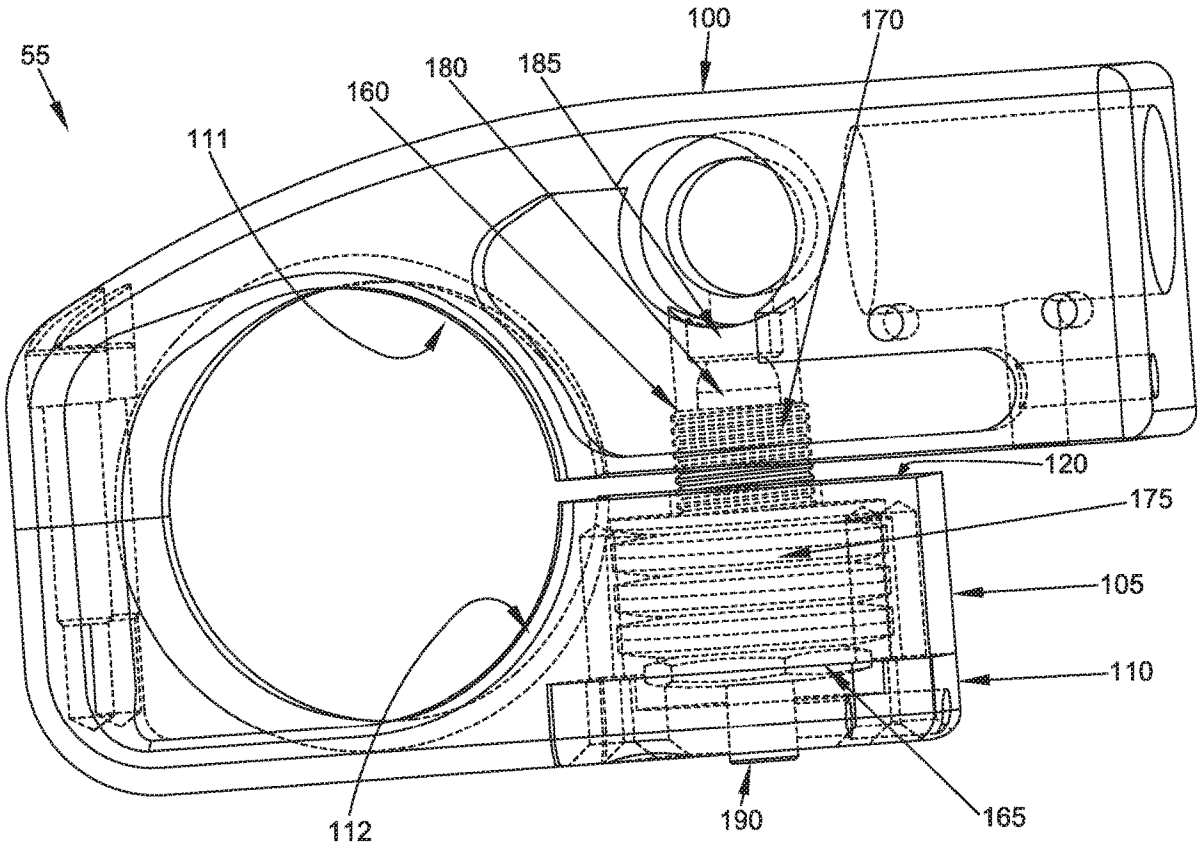
FIG. 16 is a schematic view of the clamping assembly with the upper and lower jaws rendered transparent, and with the bottom plate of the lower jaw rendered transparent.
Figure 17:
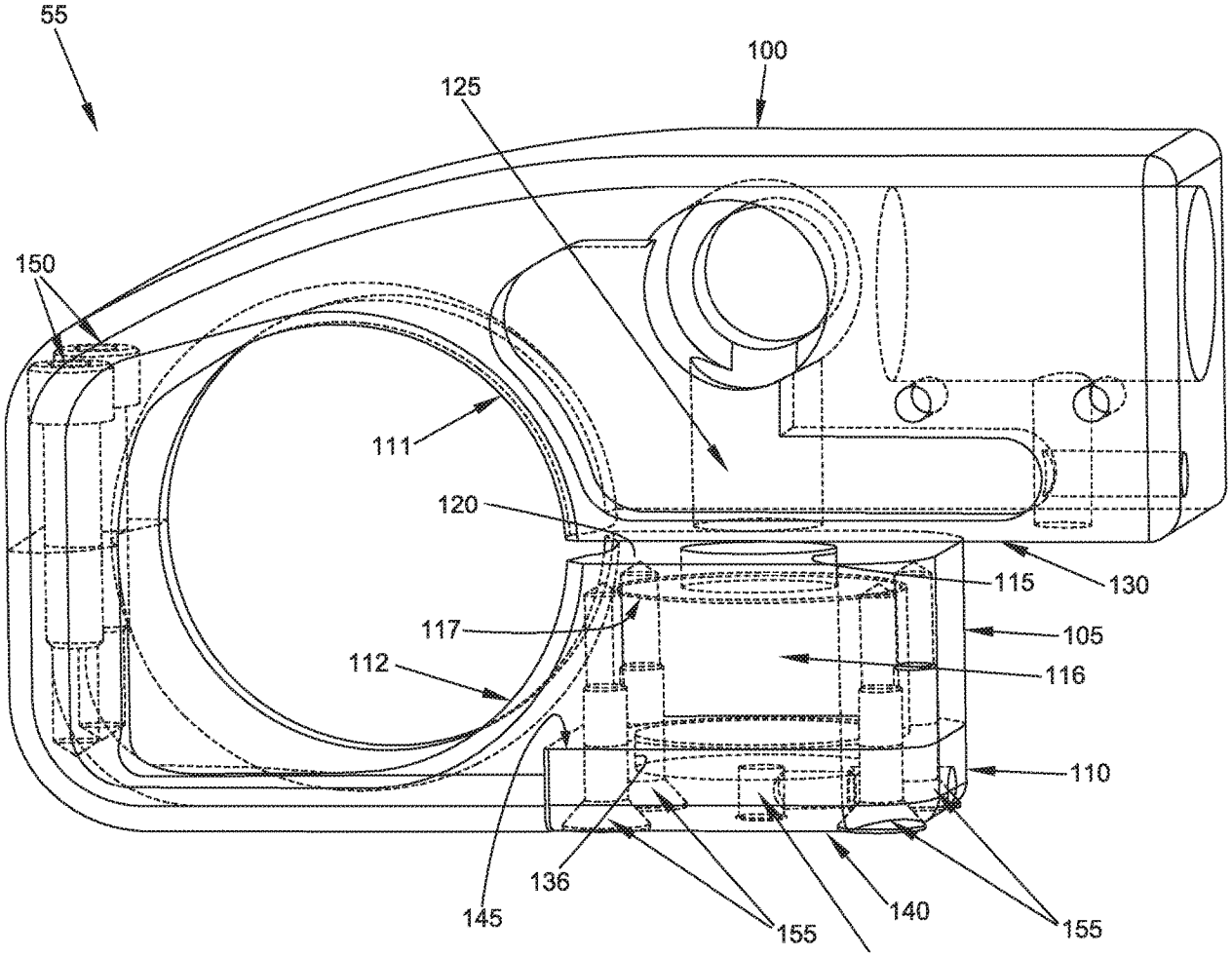
FIG. 17 is a schematic view of the clamping assembly with both the upper and lower jaws rendered transparent, with the bottom plate of the lower jaw rendered transparent, and with various internal components omitted for clarity.
Figure 18:
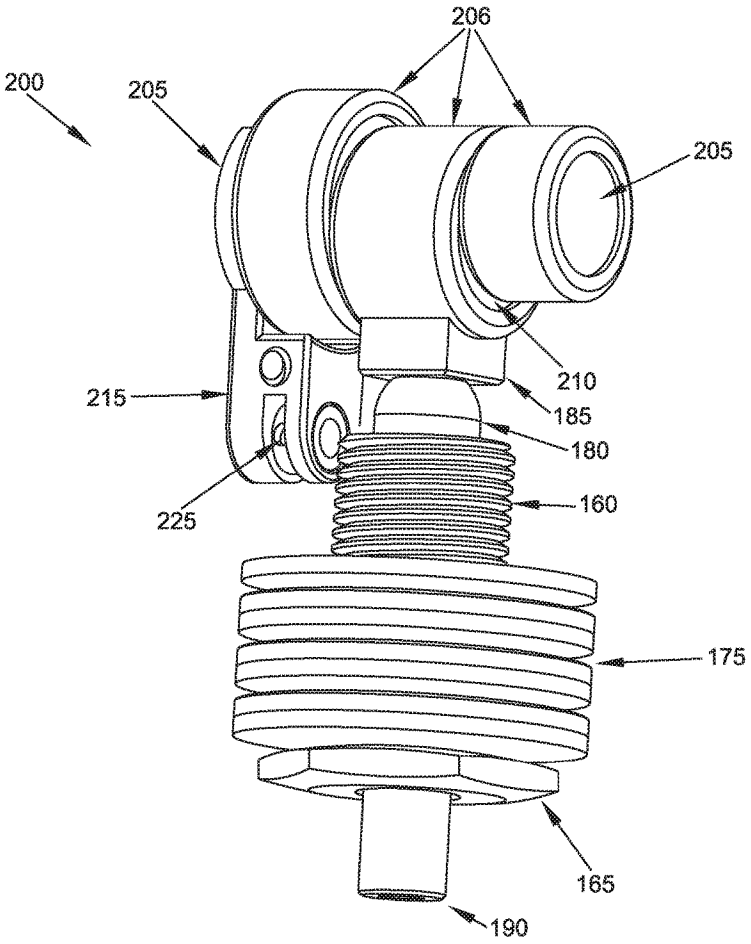
FIG. 18 is a schematic view of the cam mechanism and other selected internal components of the clamping assembly.
Figure 19:
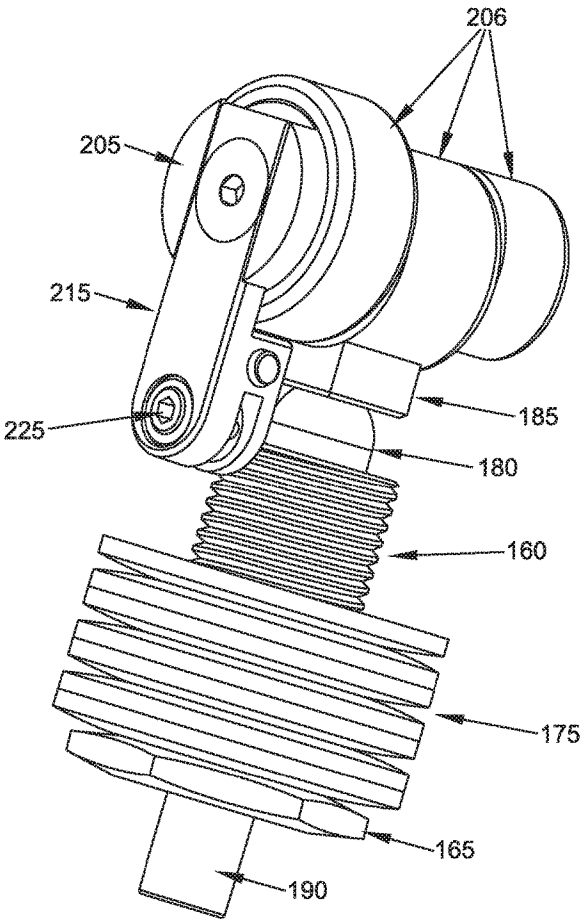
FIG. 19 is another schematic view of the components shown in FIG. 18.
Figure 20:
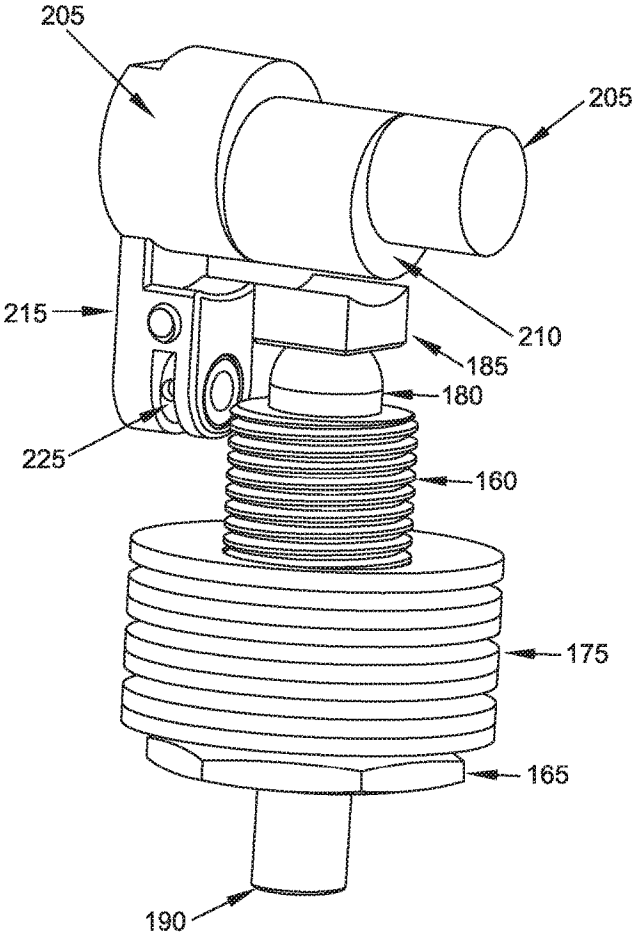
FIG. 20 is a view similar to that of FIG. 18, but with the cam bearings removed so that the entire cam is exposed.
Figure 21:
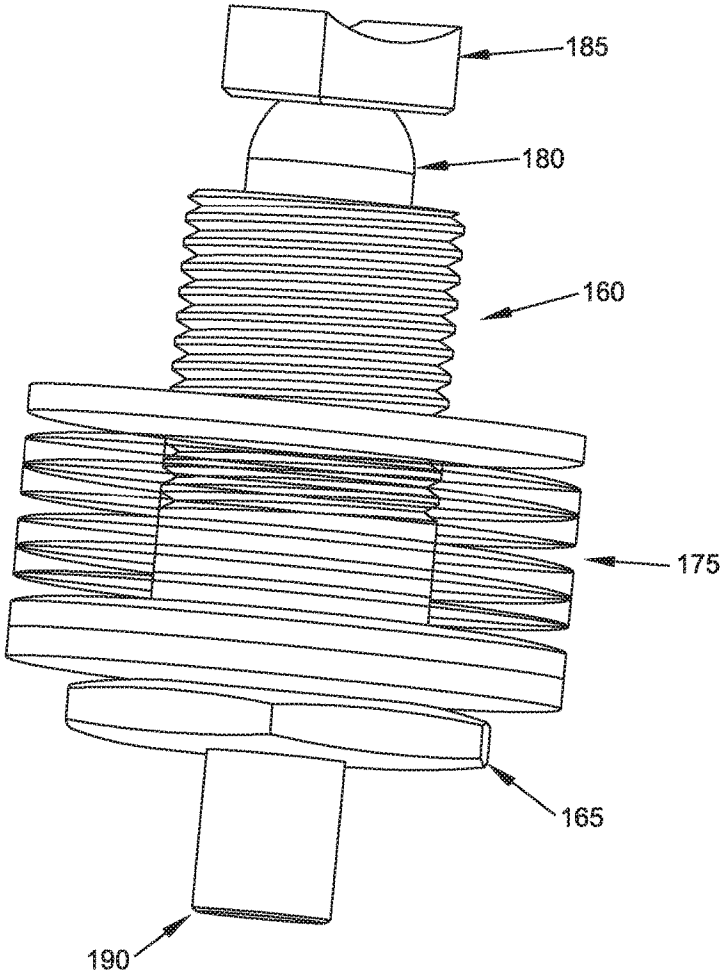
FIG. 21 is a schematic view of selected portions of the clamping assembly, with some components rendered transparent for clarity.
Figure 22:
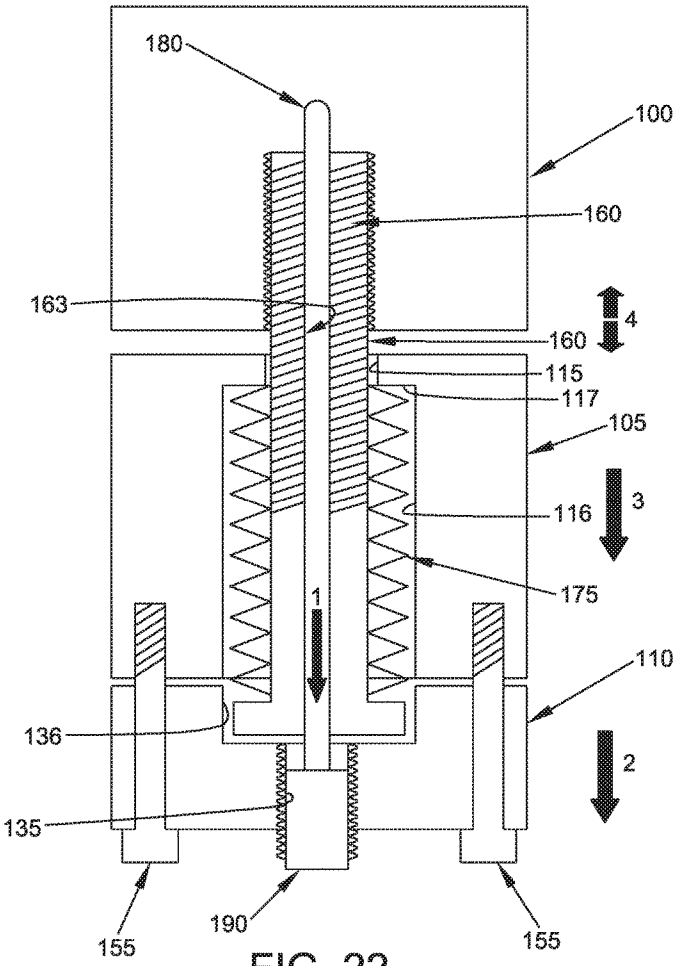
FIG. 22 is a simplified schematic view of selected components of the clamping assembly, showing the forces which act on the various components of the clamping assembly.
Figure 23:
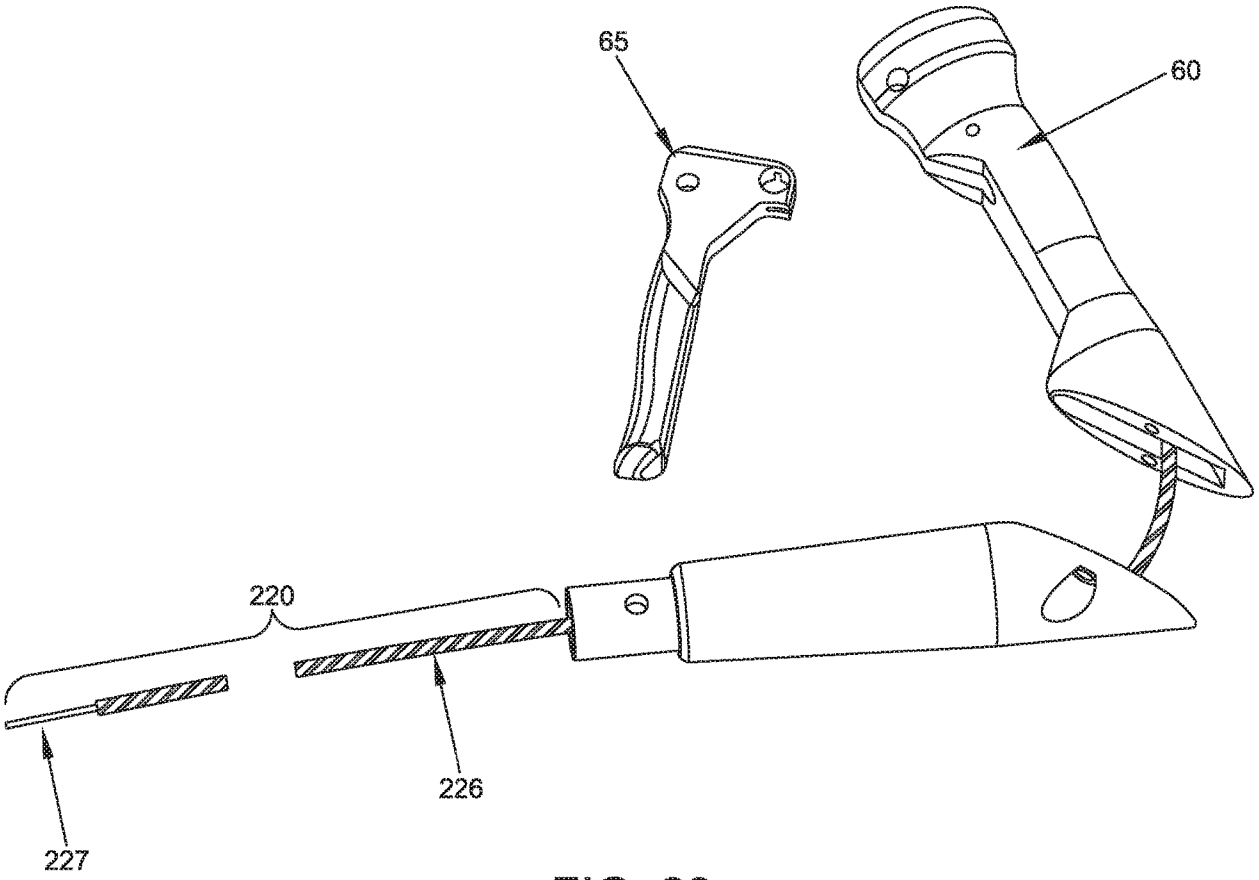
FIG. 23 is a schematic view of selected portions of the release mechanism for selectively releasing the clamping mechanism.

Turning now to FIG. 16, there is shown a spring compression bolt 160 having a head 165 and shaft 170. Spring compression bolt 160 passes through bore 115 and counterbore 116 of lower jaw 105. A portion of shaft 170 is threaded. Spring compression bolt 160 is configured with a central bore 163 (FIGS. 15 and 22) extending therethrough. Shaft 170 of spring compression bolt 160 is threadably engaged in cavity 125 of upper jaw 100, whereby to secure spring compression bolt 160 to upper jaw 100. Head 165 of spring compression bolt 160 partially resides in counterbore 116 of lower jaw 105 and in counterbore 136 of bottom plate 110.

Counterbore 116 in lower jaw 105 is sized to accommodate spring element 175, which is arranged concentrically around the shaft 170 of spring compression bolt 160. Spring element 175 is captured in counterbore 116 in lower jaw 105, between head 165 of spring compression bolt 160 and the annular shoulder 117 created where counterbore 116 meets bore 115.

On account of the foregoing construction, spring element 175 normally biases head 165 of spring compression bolt 160 away from top surface 120 of lower jaw 105; inasmuch as the opposite threaded end of spring compression bolt 160 is secured to upper jaw 100, this action normally draws upper jaw 100 and lower jaw 105 together, whereby to draw the concave gripping surface 111 of upper jaw 100 and the concave gripping surface 112 of lower jaw 105 onto spheroidal outer surface 26 of semi-ball 25. In this way, clamping assembly 55 is spring-biased so that it normally grips semi-ball 25.

Spring release pin 180 extends through central bore 163 of spring compression bolt 160. The top end of spring release pin 180 stands proud of spring compression bolt 160. The top end of spring release pin 180 may have a hemispherical shape configured to mate with the bottom surface of a cam bearing block 185 (see below) which may have a complementary hemispherical cavity. Spring release pin 180 terminates in the bottom end of shaft 170 of spring compression bolt 160 just above head 165 of spring compression bolt 160.

Bottom plate 110 receives a tension set screw 190. Tension set screw 190 is threadably engaged in bore 135 of bottom plate 110 and engages the lower end of spring release pin 180, as will hereinafter be discussed.

Cam Mechanism

Looking now at FIGS. 12-16 and 18-23, there is shown a cam mechanism 200 for selectively opening clamping assembly 55. Cam mechanism 200 is disposed in upper jaw 100 (upper jaw 100 is omitted from FIGS. 18-21 for clarity) and comprises a cam 205 which is received in bearings 206. Cam 205 contains an eccentric 210 which exerts a downward force on cam bearing block 185 when cam 205 is rotated, as will hereinafter be discussed. Cam arm 215 is configured to receive one end of cable 220 at cable anchor 225. The other end of cable 220 is connected to actuator 65. Cam arm 215 is fixedly connected to cam 205.

As will hereinafter be discussed, when cable 220 is anchored to cam arm 215 and cable 220 is pulled (i.e., by pulling on actuator 65), it causes cam arm 215 to move, whereby to cause cam 205 to rotate. The rotation of cam 205, and the corresponding rotation of eccentric 210, causes eccentric 210 to push down on cam bearing block 185, which then pushes down on spring release pin 180. As will hereinafter be discussed, this action causes upper jaw 100 and lower jaw 105 to separate, whereby to allow clamping assembly 55 and any appendages attached thereto (e.g., support bar 50) to move relative to semi-ball 25 (and hence relative to the surgical table to which semi-ball 25 is attached).

Cam arm 215 is moved by the action of cable 220, which may be similar in construction to a brake cable, and generally comprises outer jacket 226 and an inner cable 227, although the exact configuration may be altered without changing the intention of this invention.

The provision of cable 220 as an actuating means, rather than providing a solid actuating means such as a rod, is advantageous, inasmuch as the cable allows the force applied to cam arm 215 to be routed in almost any direction desired by the physician.

Thus, the cable may route the force around bends and corners and allow the positioning of cable actuator 65 in a more comfortable and/or advantageous position for the physician. In one preferred embodiment of the invention, cable 220 is routed from cable anchor 225, through upper jaw 100, into support bar 50 via portal 228 (FIG. 13), and then back through support bar 50 to handle 60.

Actuator 65 itself may be configured in the manner of a brake lever (FIGS. 3, 6-9 and 23), and like cam arm 215, provides a force multiplier that, by decreasing the force necessary to open spring element 175 and thus release the clamping force of upper jaw 100 and lower jaw 105 from the semi-ball 25, improves the action of the device for the physician.

It is important to realize that when tension is applied to cable 220 by the physician through actuator 65, cam arm 215 applies a rotational force to cam 205 which forces lower jaw 105 to separate (against the biasing force of spring element 175) from upper jaw 100, whereby to cause clamping assembly 55 to open. This action releases the clamping force of concave gripping surface 111 of upper jaw 100 and the concave gripping surface 112 of lower jaw 105 on semi-ball 25, which then allows clamping assembly 55 to move about any and/or all of the axes of semi-ball 25.

Further Details Regarding Opening and Closing of the Clamping Assembly

When eccentric 210 is not exerting force on cam bearing block 185 (i.e., when clamping assembly 55 is in its resting or non-actuated state), clamping assembly 55 is clamped around semi-ball 25. The force exerted on semi-ball 25 by upper jaw 100 and lower jaw 105 of clamping element 55 is sufficient to prevent relative movement between semi-ball 25 and clamping assembly 55.

More particularly, when clamping assembly 55 is in its resting or non-actuated state, spring element 175 is exerting a force on spring compression bolt 160 which pulls upper jaw 100 and lower jaw 105 toward one another. This force urges the concave gripping surface 111 of upper jaw 100 and the concave gripping surface 112 of lower jaw 105 against the spheroidal outer surface 26 of semi-ball 25. The force exerted on semi-ball 25 by concave gripping surface 111 of upper jaw 100 and concave gripping surface 112 of lower jaw 105 is sufficient to prevent relative movement between clamping assembly 55 and semi-ball 25. Thus, support bar 50 and all of the components attached thereto (e.g., boot 70) are similarly prevented from moving relative to semi-ball 25, resulting in the immobilization of leg support assembly 15 with respect to the surgical table.

When cam mechanism 200 is actuated (e.g., by pulling actuator 65), lower jaw 105 is forced (against the bias of spring element 175) to move away from upper jaw 100, thereby permitting clamping assembly 55 (and the components attached thereto) to move relative to semi-ball 25.

More particularly, cam mechanism 200 is actuated by rotating cam 205 (e.g., by pulling cable 220, which is connected to cam arm 215, which is connected to cam 205). When cam 205 is rotated, eccentric component 210 of cam 205 exerts a downward force on cam bearing block 185, which in turn exerts a downward force on spring release pin 180. This motion is represented by Arrow 1 shown in FIG. 22.

As previously discussed, spring release pin 180 runs through central bore 163 of spring compression bolt 160, and the downward force on spring release pin 180 causes it to contact and exert a downward force on tension set screw 190. Inasmuch as tension set screw 190 is fixed to bottom plate 110, the downward motion of spring release pin 180 applies a downward force to bottom plate 110. This motion is represented by Arrow 2 shown in FIG. 22.

The downward force applied to bottom plate 110 by spring release pin 180 is transmitted to lower jaw 105 by virtue of screws 155 which connect bottom plate 110 to lower jaw 105. This motion is represented by Arrow 3 shown in FIG. 22. As a result, lower jaw 105 is forced downward (against the bias of spring element 175) and hence away from upper jaw 100. This motion is represented by Arrow 4 shown in FIG. 22.

By increasing the distance between upper jaw 100 and lower jaw 105, concave gripping surface 111 of upper jaw 100 and concave gripping surface 112 of lower jaw 105 are each moved away from the spheroidal outer surface 26 of semi-ball 25. Accordingly, the force exerted by clamping assembly 55 on semi-ball 25 is reduced, allowing relative movement between the two components as discussed above.

Clamping assembly 55 may be restored to its initial state (i.e., that which prohibits relative movement between semi-ball 25 and clamping assembly 55) by discontinuing the application of force to the cam mechanism 200 (e.g., by discontinuing the application of force to cable 220 via actuator 65). By discontinuing the application of force to cam mechanism 200, the force exerted by cam 205 on spring release pin 180 will be overcome by the force exerted by spring element 175 (i.e., on head 165 of spring compression bolt 160 and annular shoulder 117 at the intersection of bore 115 and counterbore 116), which in turn exerts an upward force on lower jaw 105. This has the effect of reducing the distance between upper jaw 100 and lower jaw 105 and allowing clamping assembly 55 to again fit tightly around semi-ball 25, thereby preventing relative movement therebetween.

In addition, as lower jaw 105 and bottom plate 110 return upward, tension set screw 190 exerts an upward force on spring release pin 180, which accordingly pushes cam bearing block 185 upward and rotates cam 205 back to its initial position, with eccentric 210 not exerting downward force on cam bearing block 185.

Use of the Present Invention

Looking now at FIGS. 24-29, to achieve a controlled simulation of a ball-and-socket arrangement of mechanical elements, the present invention uses the truncated or semi-ball 25 gripped by upper jaw 100 and lower jaw 105, i.e., gripped between concave gripping surface 111 of upper jaw 100 and concave gripping surface 112 of lower jaw 105 that fit around the spheroidal outer surface 26 of the semi-ball in a concentric manner.

Figure 6:
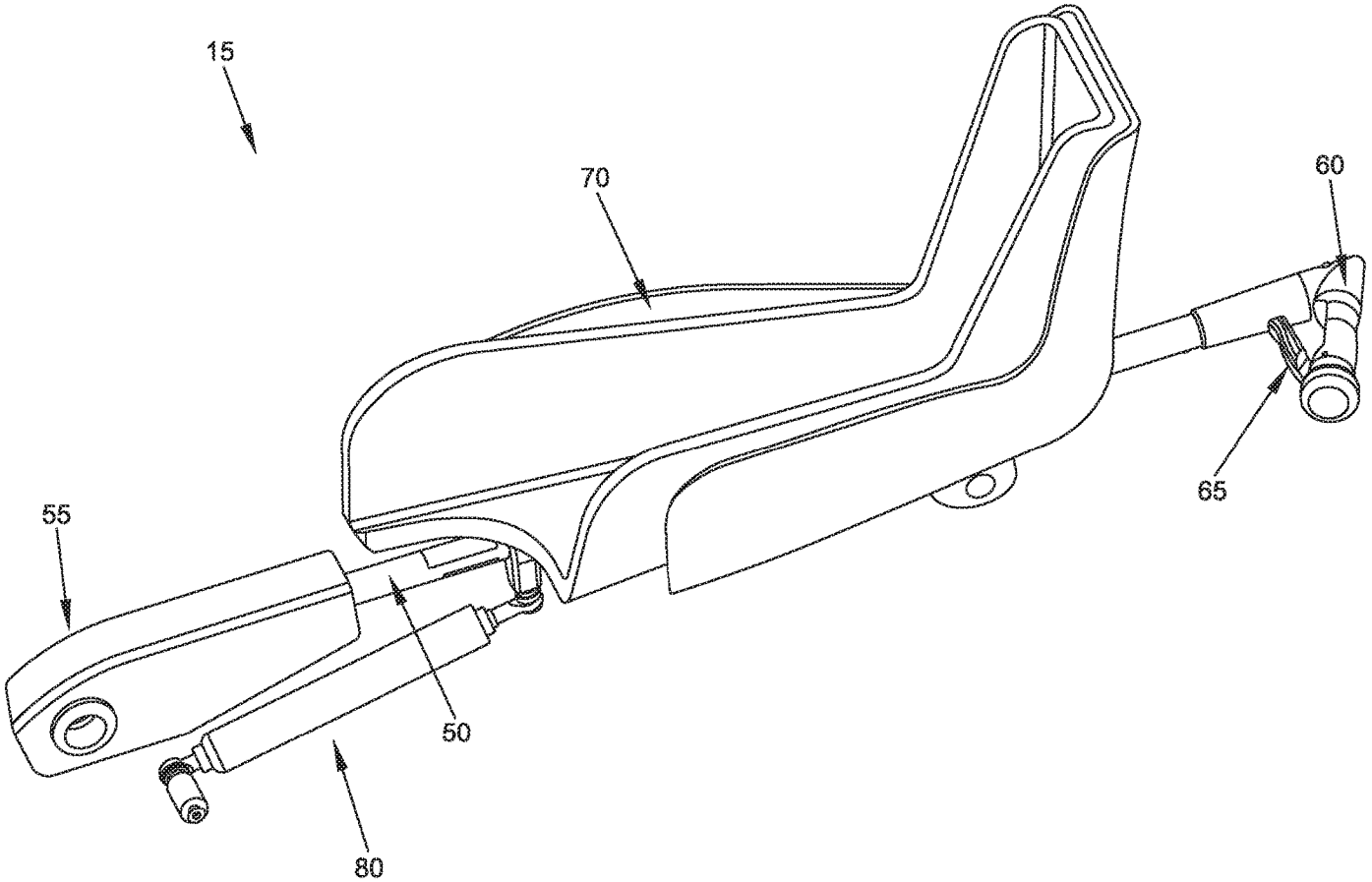
FIG. 6 is a schematic view of the leg support assembly of the adjustable leg holder shown in FIG. 1.
Figure 7:
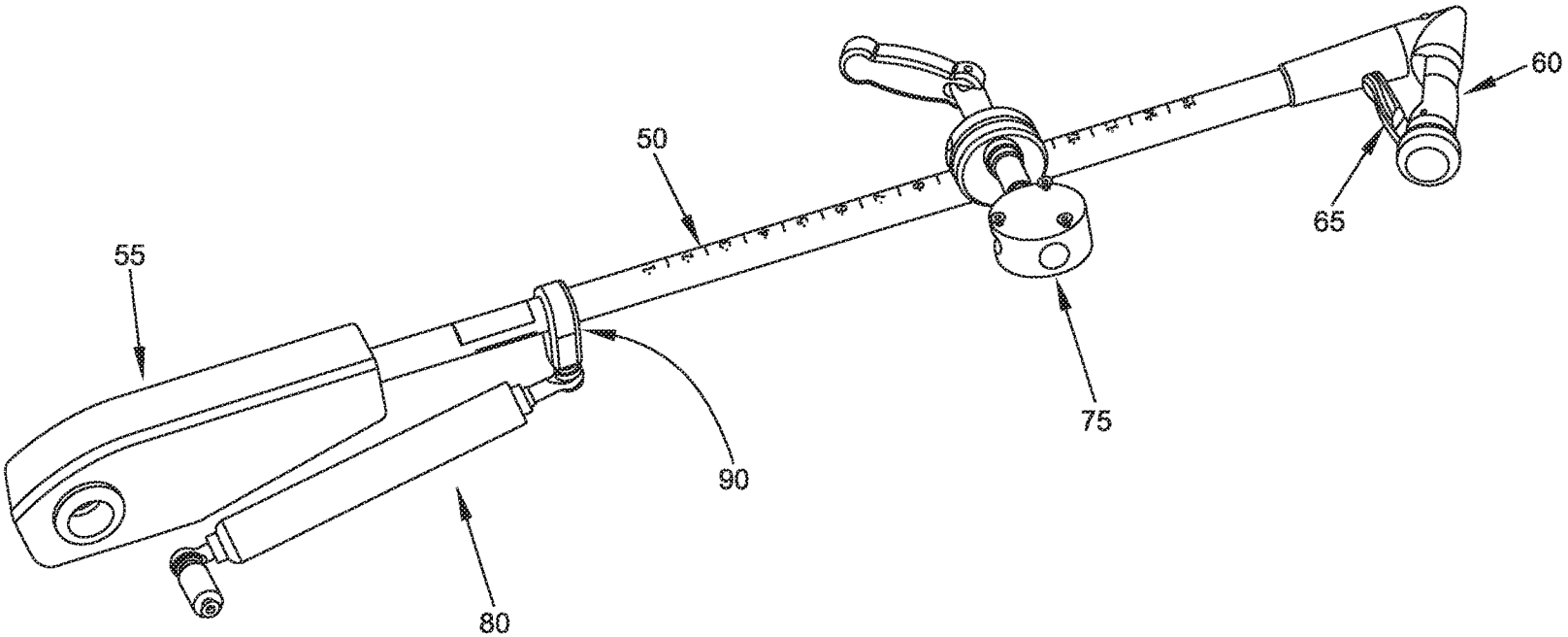
FIG. 7 is a schematic view of the leg support assembly shown in FIG. 6, but with the boot component removed.
Figure 8:
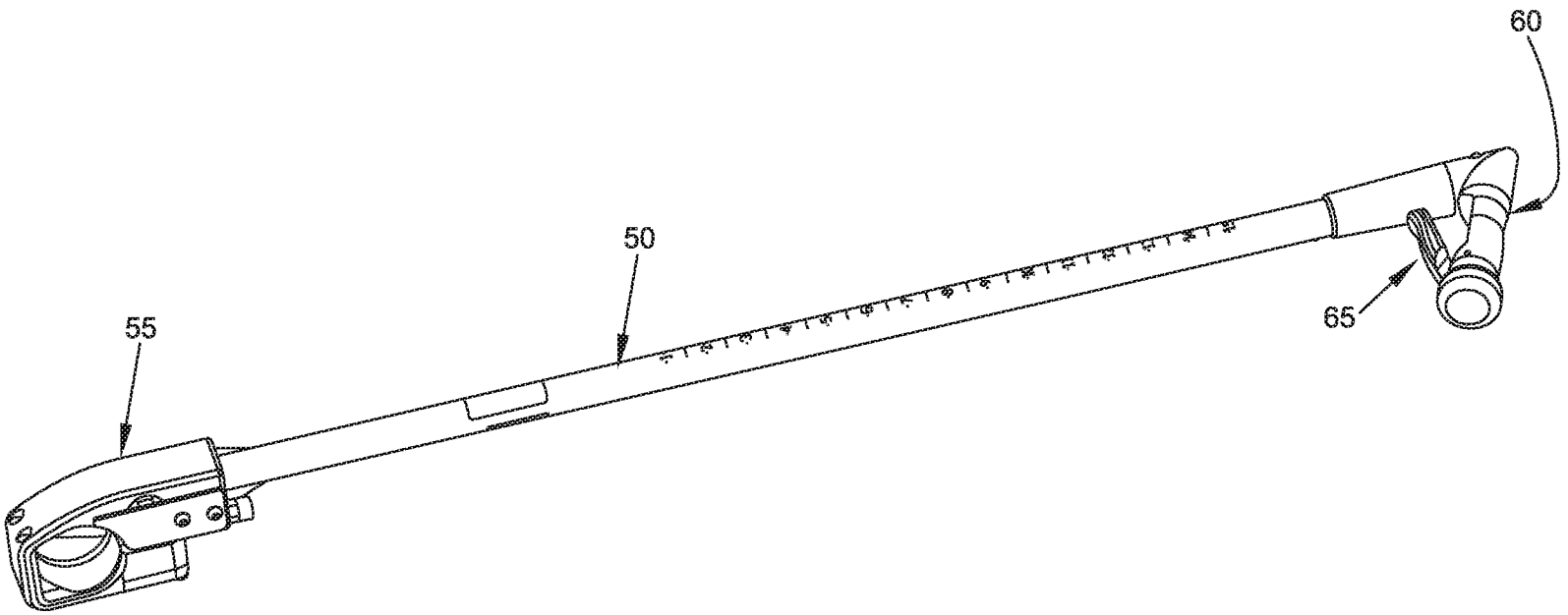
FIG. 8 is a schematic view of the leg support assembly with selected components removed, showing the support rod, the clamping assembly and the handle of the support rod.
Figure 9:
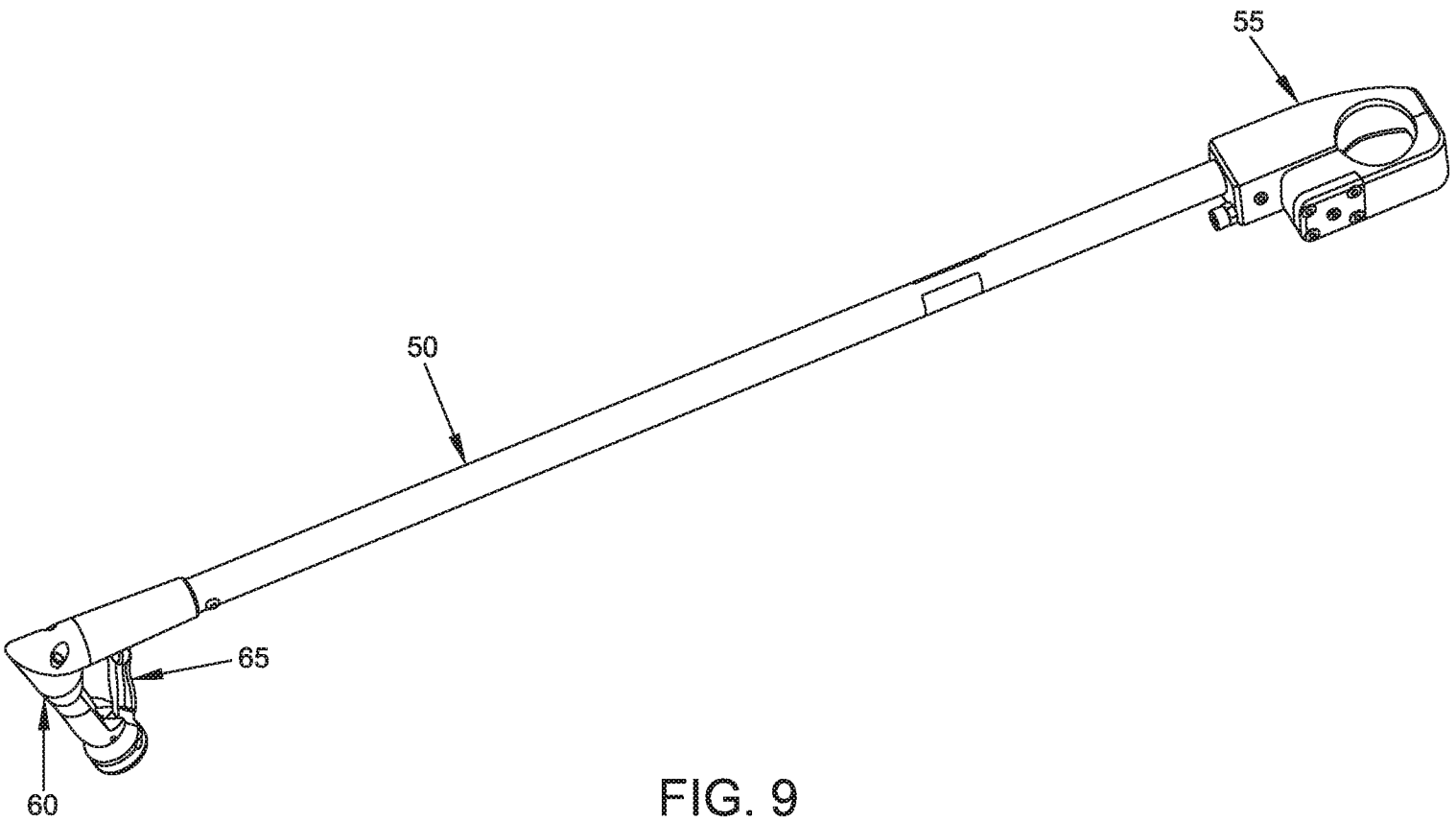
FIG. 9 is another schematic view showing the apparatus of FIG. 8.
Figure 10:
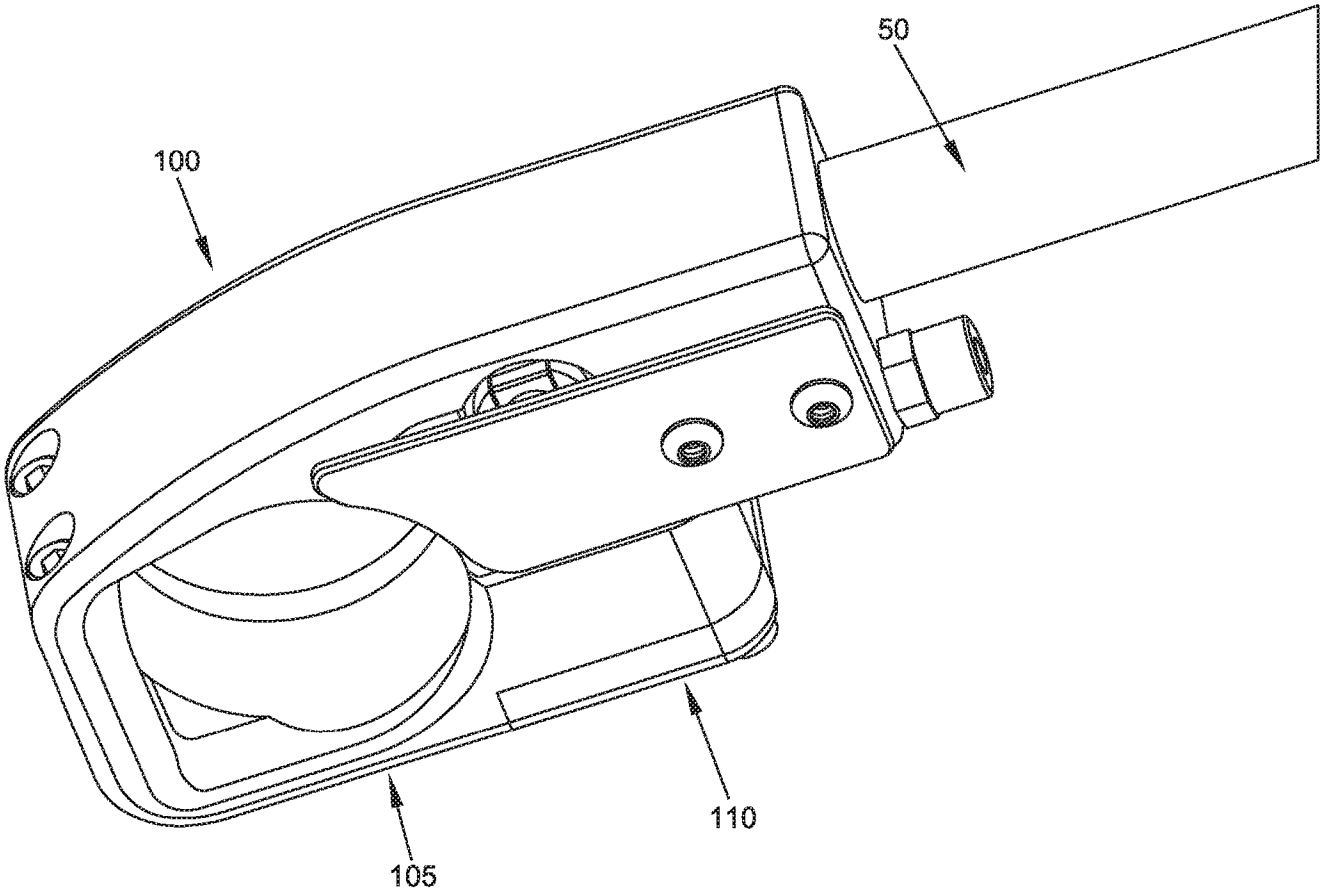
FIG. 10 is a schematic view of the clamping assembly portion of the leg support assembly.
Figure 11:
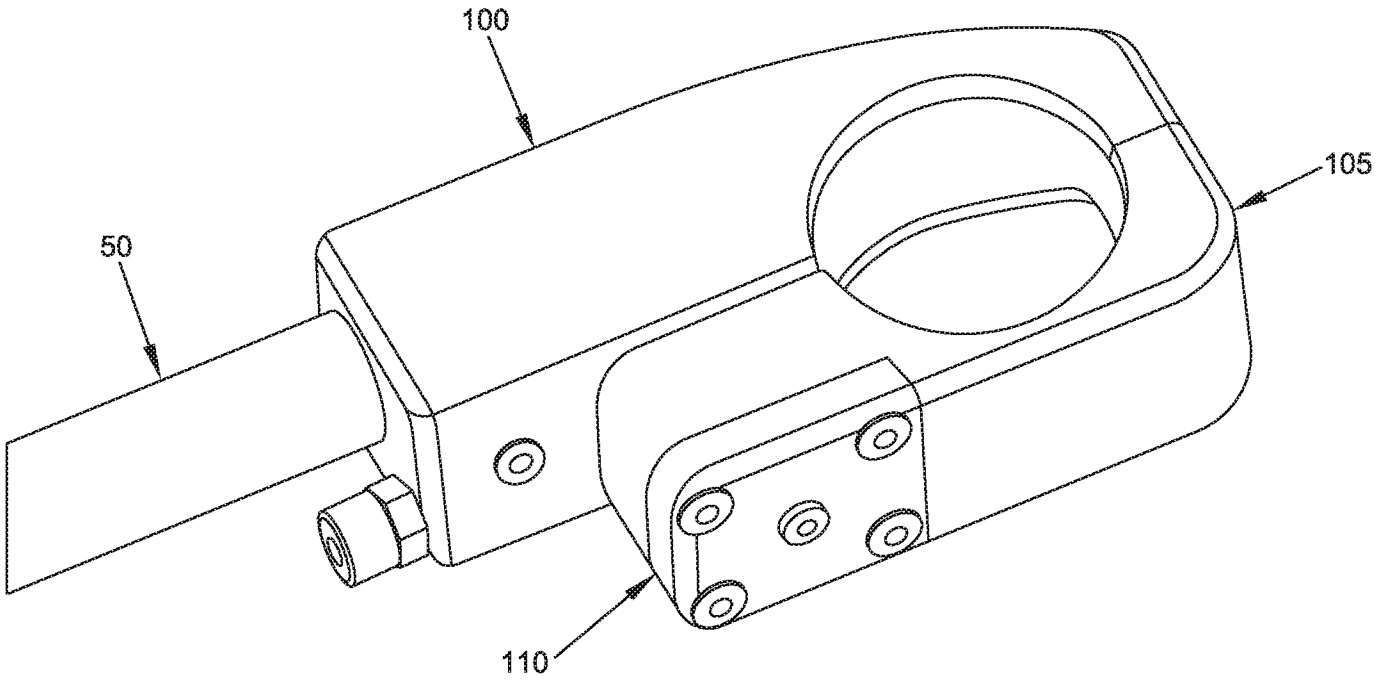
FIG. 11 is another schematic view of the clamping assembly shown in FIG. 10.
Figure 12:
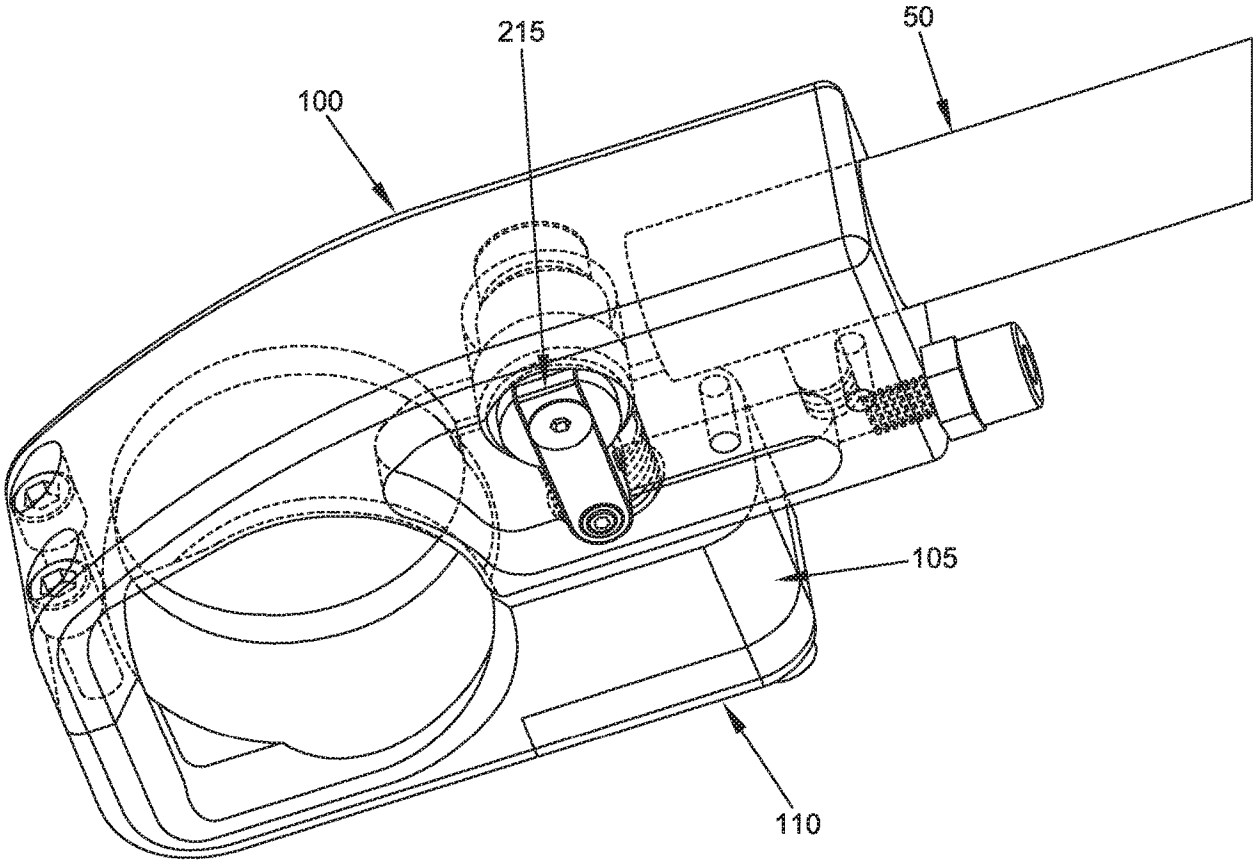
FIG. 12 is a schematic view similar to that shown in FIG. 10, but with the upper jaw of the clamping assembly rendered transparent so as to show internal structure.
Figure 13:
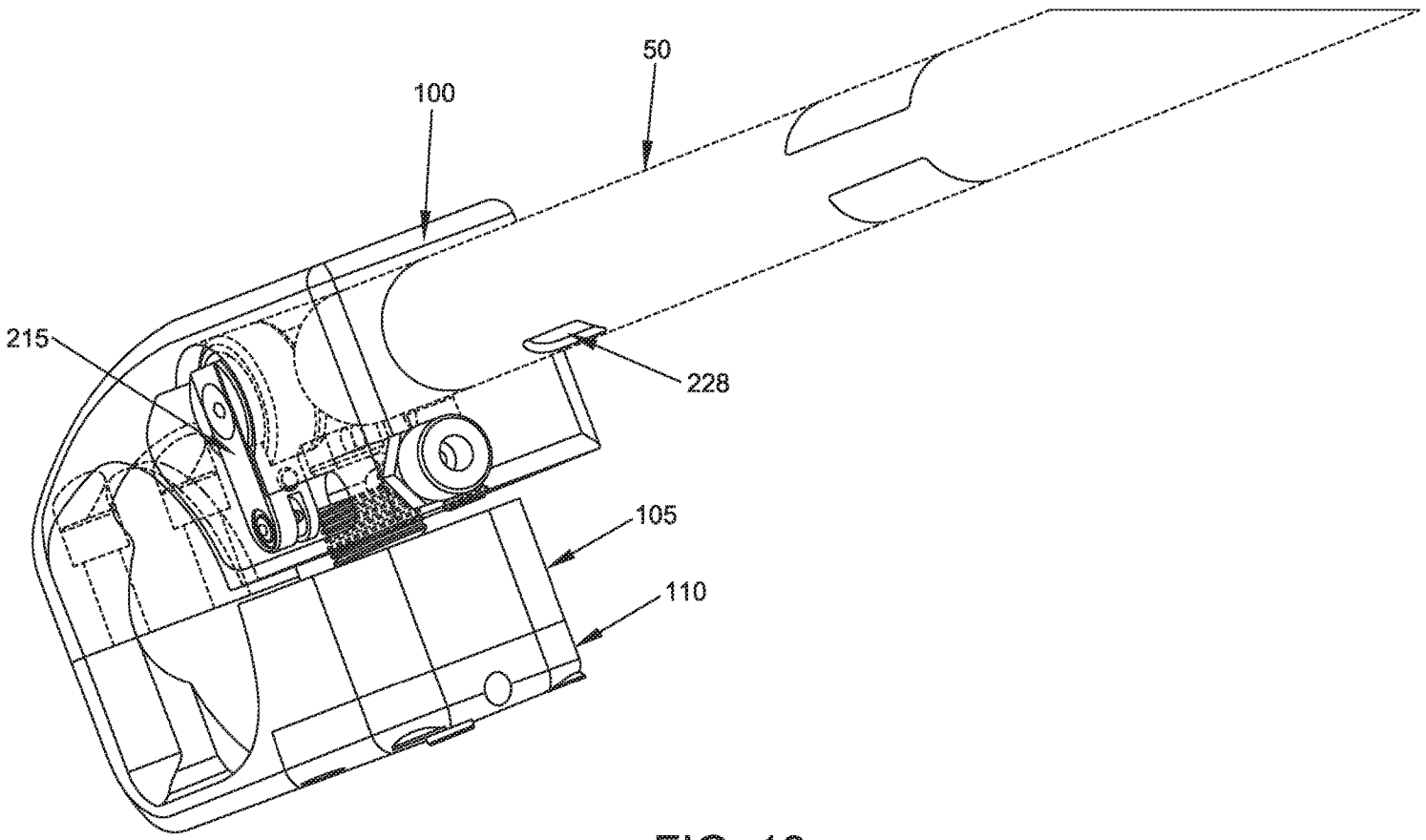
FIG. 13 is another schematic view of a portion of the leg support assembly with the upper jaw of the clamping assembly rendered transparent.
Figure 14:
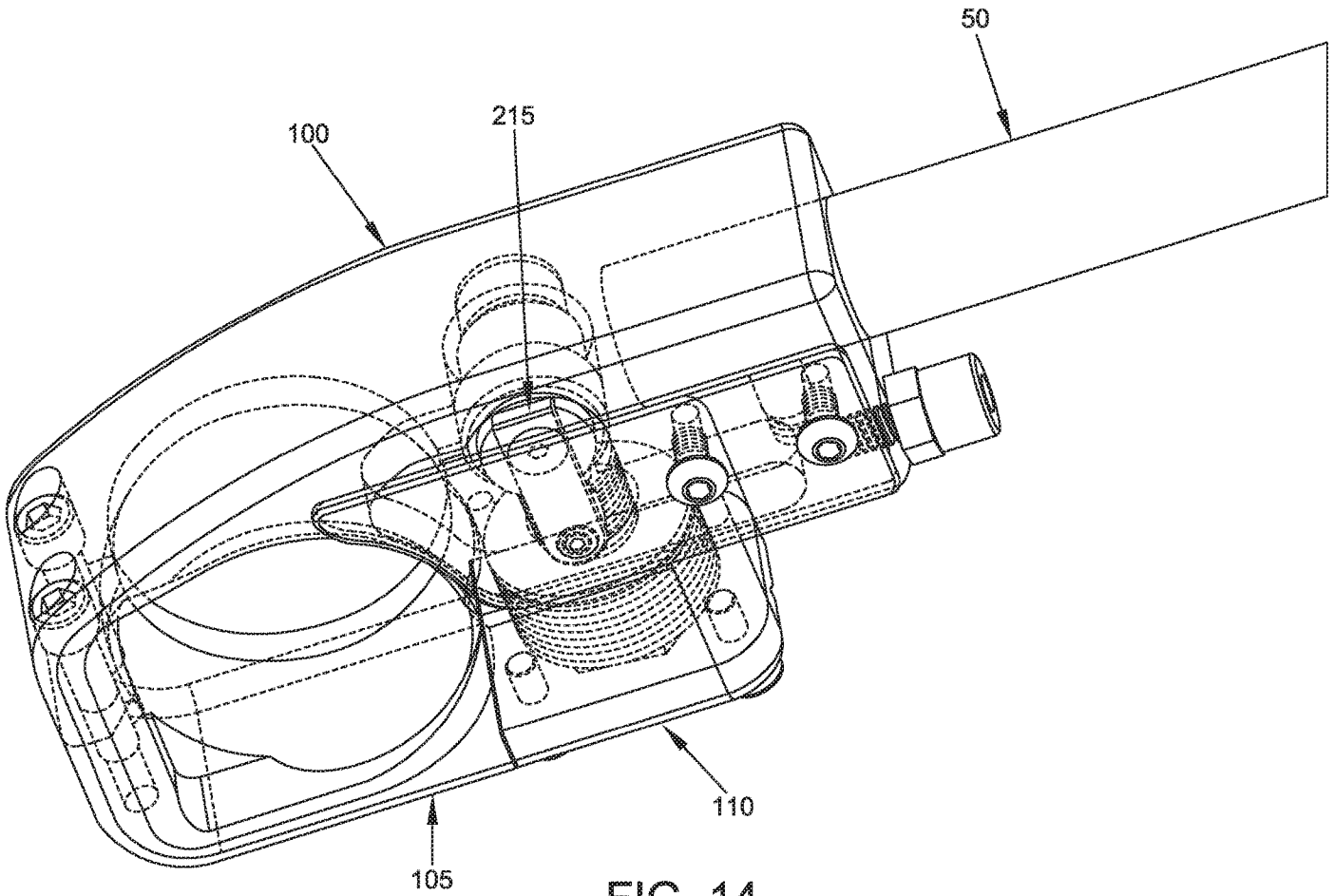
FIG. 14 is a schematic view similar to that shown in FIG. 12, but with the lower jaw also rendered transparent so as to show internal structure.
Figure 15:
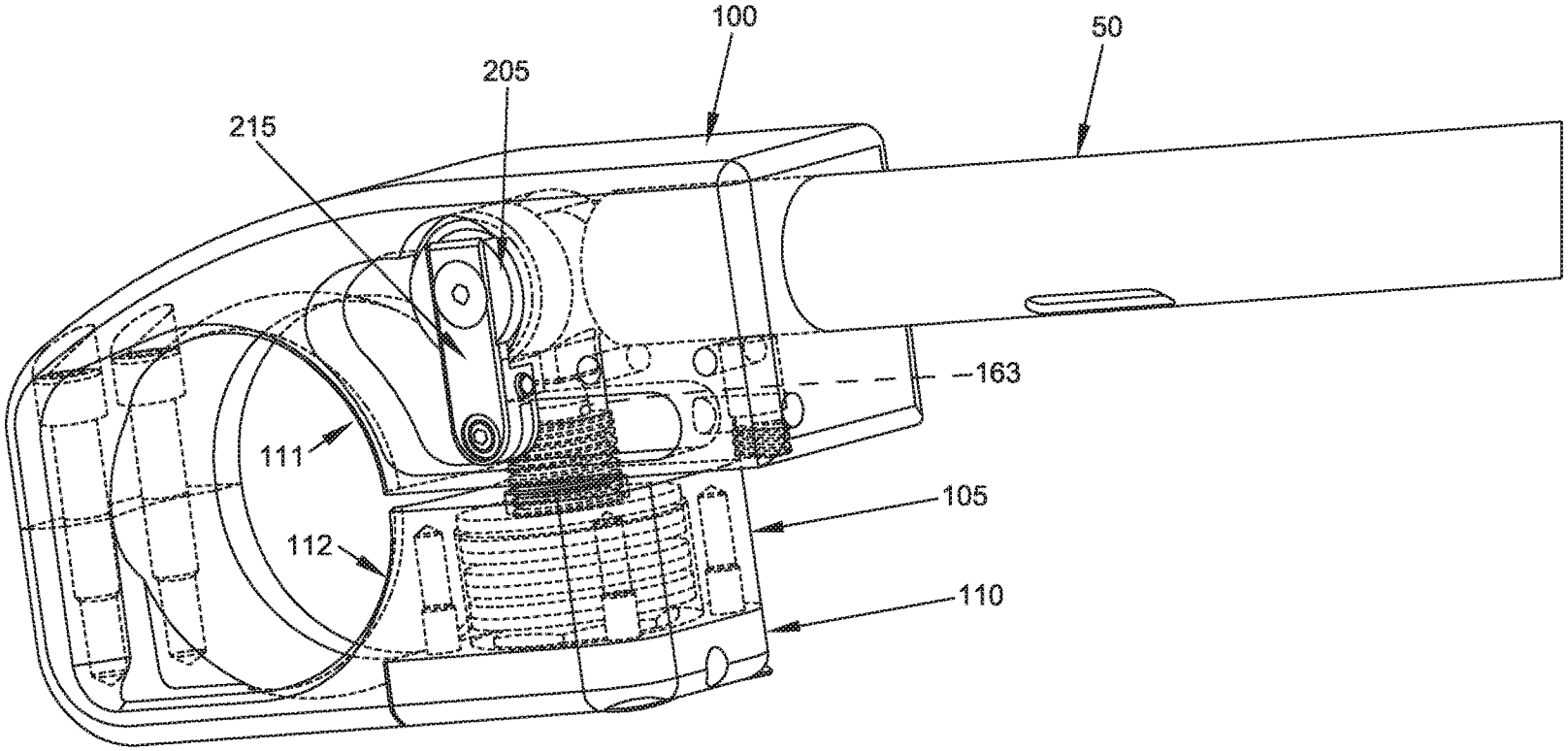
FIG. 15 is a schematic view of the clamping assembly with both the upper and lower jaws rendered transparent.

The range of rotational movement that the device can make around the semi-ball's longitudinal axis is controlled by the compressed and extended length of gas cylinder 80 (see FIG. 6).

The device can move rotationally about two additional axes that are at right angles to each other, and to the previously-described longitudinal axis of the semi-ball 25.

These additional rotational motions can be thought of as "pitch" and "yaw", and are controlled by the interaction between a limit surface 300 on upper jaw 100 against upper semi-ball pin 40 and the interaction between a limit surface 305 on lower jaw 105 against lower semi-ball pin 45.

Figure 24:
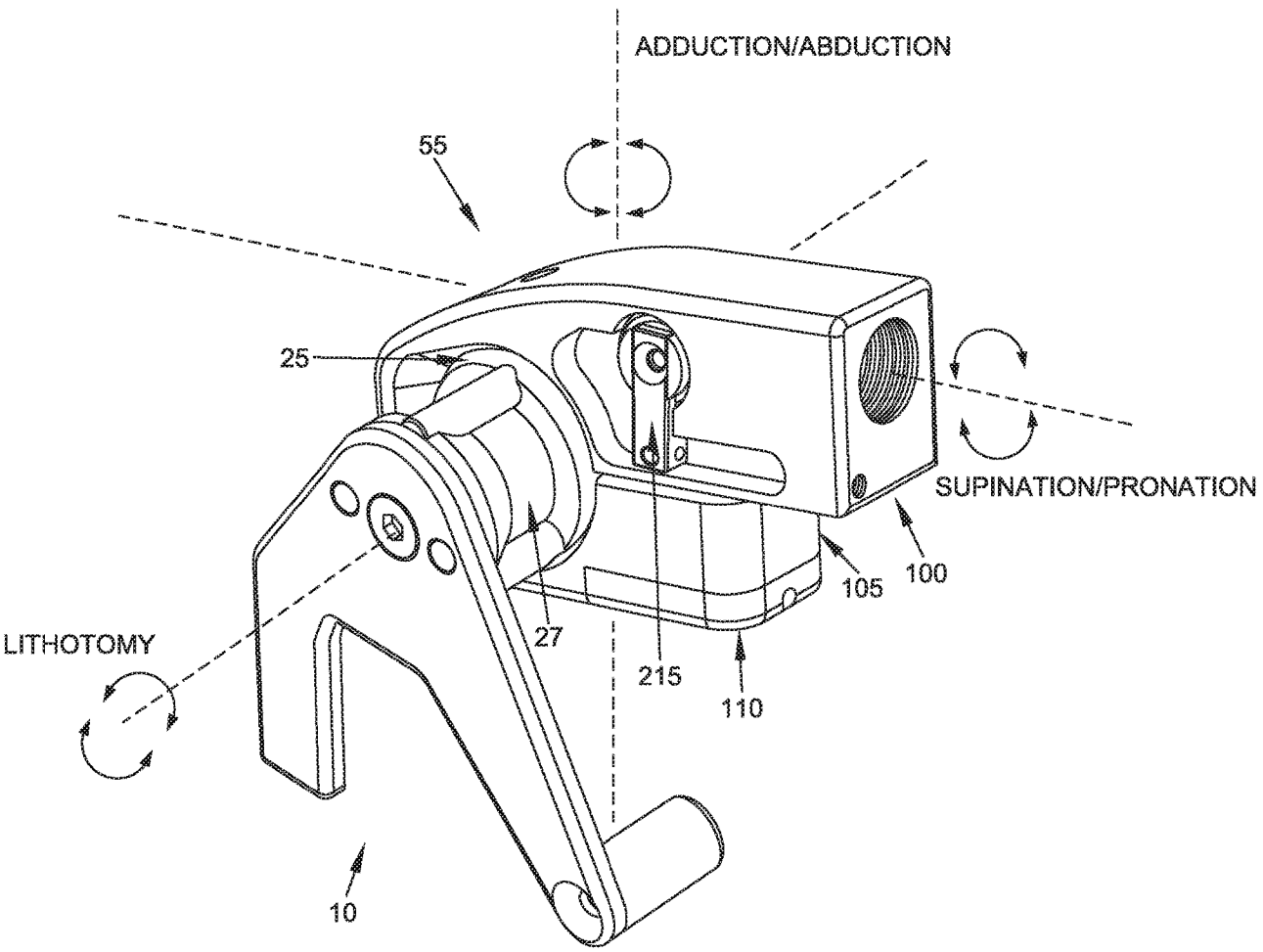
FIG. 24 is a schematic view of the clamping assembly coupled to the mount assembly.
Figure 25:
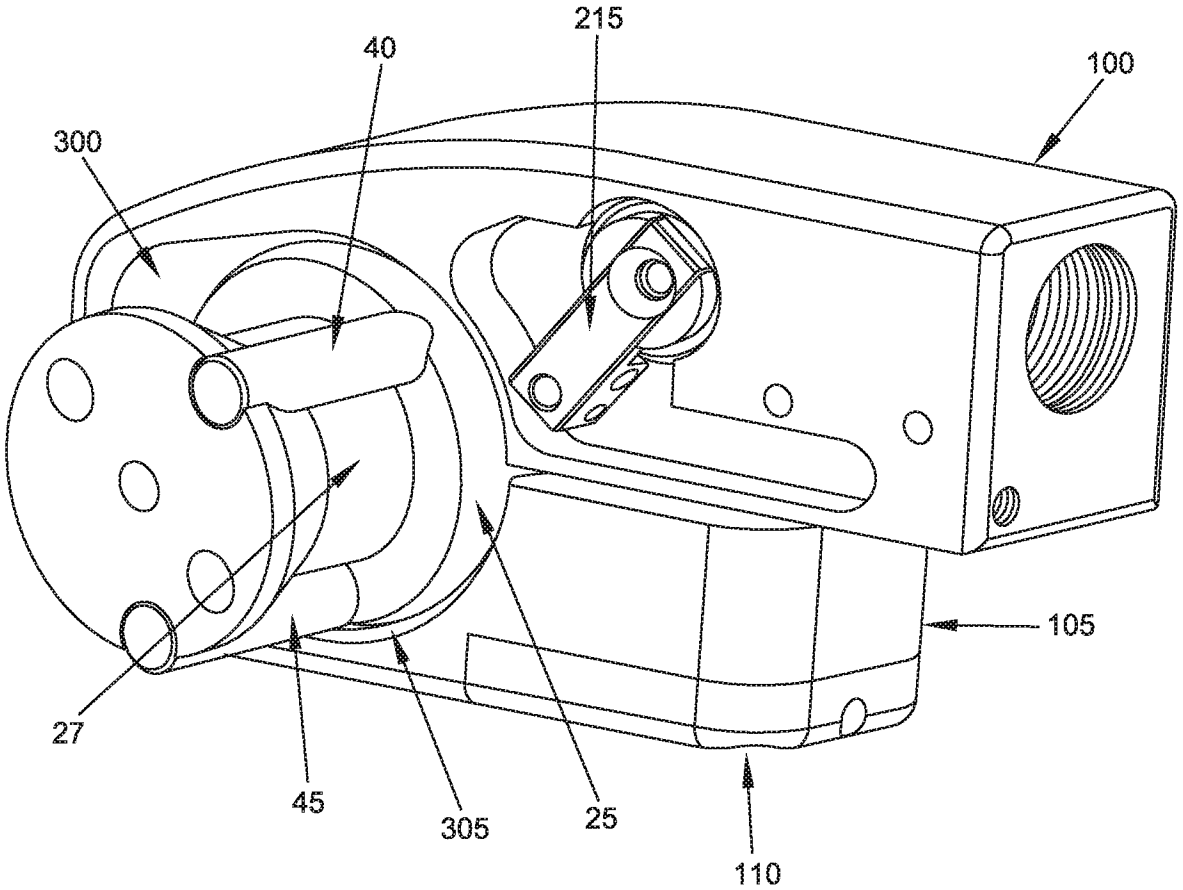
FIG. 25 is another schematic view of the clamping assembly mounted to the semi-ball of the mount assembly.
Figure 26:
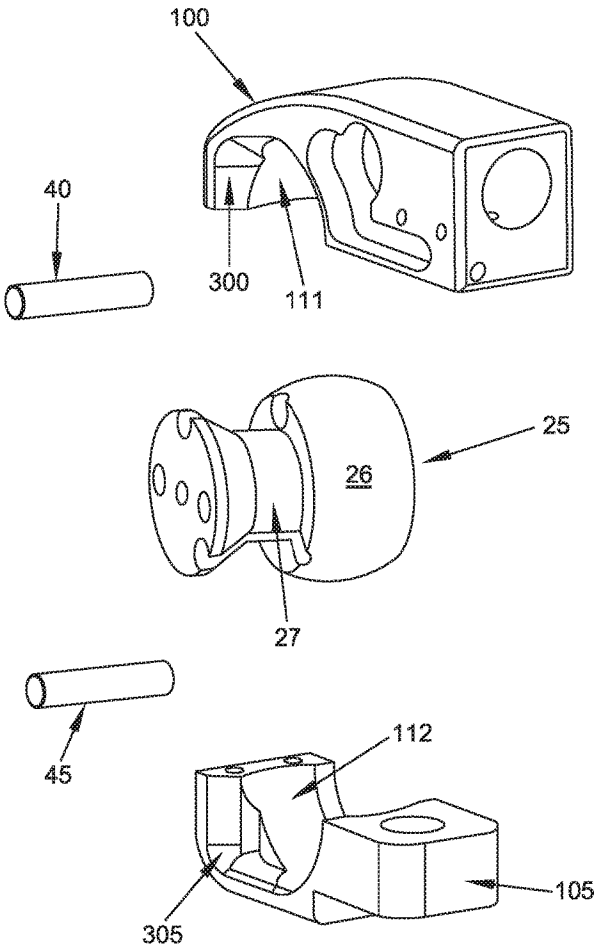
FIGS. 26-28 are schematic views showing further details of various elements shown in FIGS. 24 and 25.
Figure 27:
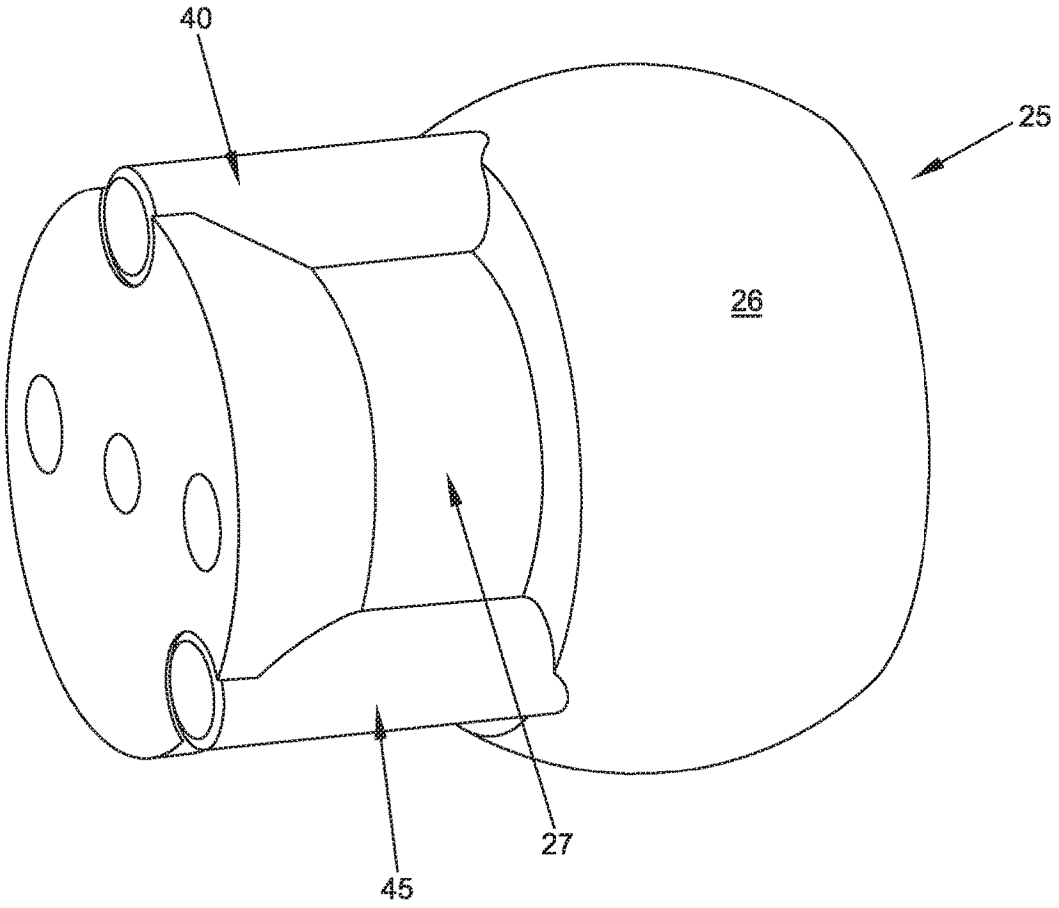
Figure 28:
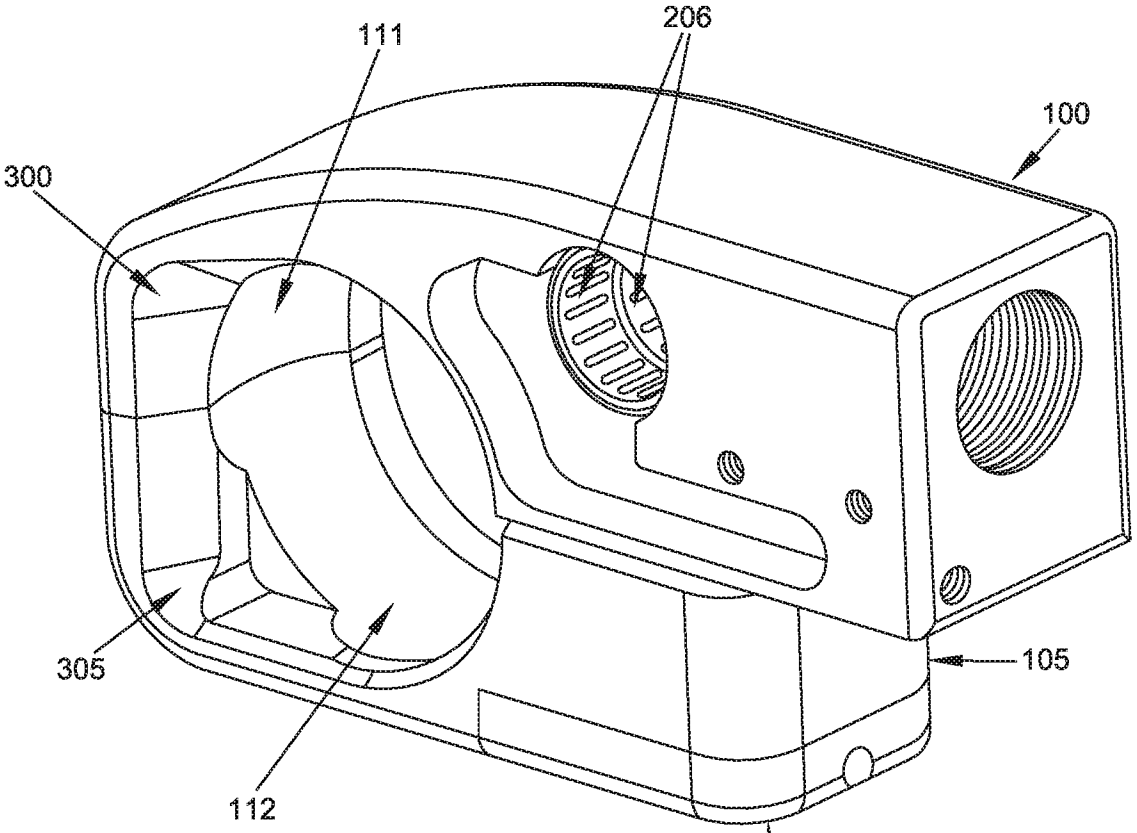
Figure 29:
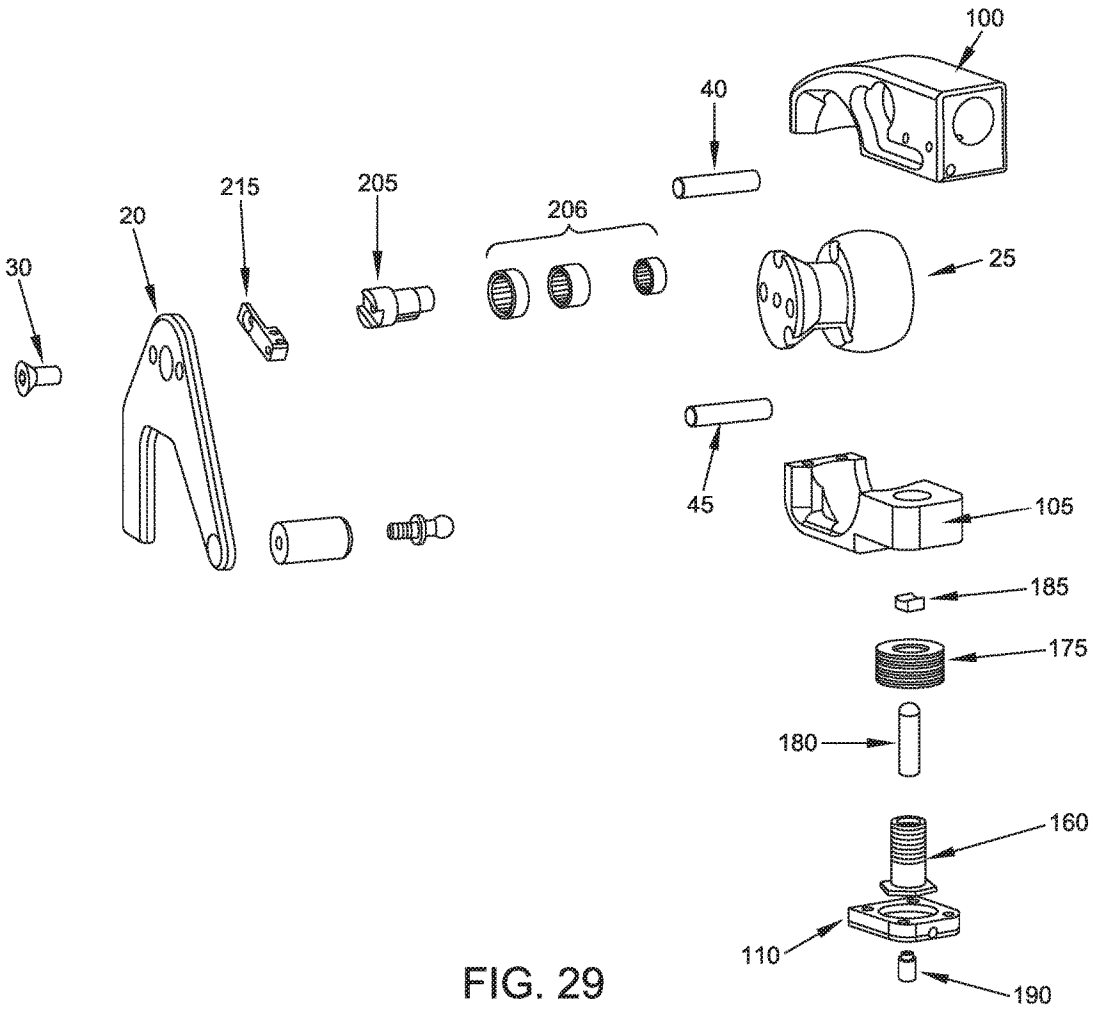
FIG. 29 is an exploded view showing various components of the adjustable leg holder of the present invention.

The "roll", "pitch" and "yaw" movements of clamping assembly 55 about semi-ball 25 correspond to the supination/pronation, lithotomy and abduction/adduction movement of the assembled device (see FIG. 24).

As discussed above, the ability of clamping assembly 55 to rotate about semi-ball 25 is controlled by upper jaw 100 and lower jaw 105 which act as a clamp around the semi-ball.

Normally upper jaw 100 and lower jaw 105 are held in the clamping position about semi-ball 25 by spring element 175 as previously discussed.

It will be understood that any spring configuration of sufficient force will prevent clamping assembly 55 from turning about any of the axes of semi-ball 25. Spring element 175 shown herein is intended to be illustrative and not limiting, and may be altered in many ways without changing the intention of this invention.

Looking now at FIGS. 24-29, the combined interaction of several elements (i.e., upper limiting pin 40, lower limiting pin 45, upper limit surface 300 on upper jaw 100 and lower limit surface 305 on lower jaw 105) limits and refines the allowed motion of clamp assembly 55 and hence limits and refines the allowed motion of the stirrup boot attached to the clamp assembly.

In a preferred embodiment, engagement of upper limit surface 300 and lower limit surface 305 with upper limiting pin 40 and lower limiting pin 45, respectively, restricts the adduction angle at high lithotomy to 9° and the adduction angle at low lithotomy to 9°.

Also, in a preferred embodiment, the contact of upper limit surface 300 and lower limit surface 305 with the neck 27 of semi-ball 25 restricts the abduction angle in all positions to the 25° angle considered to be a maximum abduction angle in lithotomy positioning.

It will be realized that this description of the restrictions provided by upper limiting pin 40 and lower limiting pin 45, and upper limit surface 300 and lower limit surface 305, are illustrative of a preferred embodiment only, and that the same or similar elements, with differing dimensions, will produce differing restrictions without changing the sense of the invention.

Thus it will be seen that the present invention provides a stirrup-type leg holder 5, wherein the stirrup-type leg holder comprises a mounting bracket 20 for attachment to a surgical table; a semi-ball 25 for attachment to mounting bracket 20; a clamping assembly 55 comprising upper jaw 100 and lower jaw 105 for clamping engagement about semi-ball 25; and a stirrup boot 70 mounted to clamping assembly 55 via support rod 50. A release mechanism is provided to selectively release clamping assembly 55 so as to allow stirrup boot 70 to be repositioned relative to semi-ball 25 (and hence repositioned relative to the surgical table). The release mechanism comprises an actuating mechanism (e.g., a handle 60 and actuator or trigger 65) which controls a cam mechanism 200 which can force upper jaw 100 and lower jaw 105 apart, against the bias of spring element 175, whereby to allow upper jaw 100 and lower jaw 105 to rotate about semi-ball 25, and hence allow the position of stirrup boot 70 to be adjusted relative to the surgical table. In one preferred construction, semi-ball 25 comprises upper limiting pin 40 and lower limiting pin 45 which cooperate with upper limit surface 300 on upper jaw 100 and lower limit surface 305 on lower jaw 105 to limit rotation of the upper and lower jaws about the semi-ball. Gas cylinder 80 is also provided to assist in positioning the leg support assembly 15 relative to the surgical table.

In the foregoing description, mount assembly 10 is described as comprising a mounting bracket 20 and a semi-ball 25, wherein semi-ball 25 comprises an outer surface 26 following a spheroidal geometry, and a neck 27 extending along the longitudinal axis of the semi-ball. However, it should be appreciated that if desired, semi-ball 25 may be replaced by a different mounting element comprising an outer surface 26 following a spheroidal geometry, e.g., a substantially complete sphere, etc. Furthermore, if desired, neck 27 may be omitted and semi-ball 25 (and/or such alternative mounting element, e.g., a substantially complete sphere) may be mounted directly to mounting bracket 20.

It will be appreciated that numerous benefits are obtained by using the novel leg holder 5 of the present invention. First and foremost, the ball-and-socket type connection between mount assembly 10 and leg support assembly 15 allows for a greater range of motion along more axes of rotation, allowing the physician to place a patient's leg in the optimal position for a particular procedure. As a result, the physician is provided with a better operating environment, increasing the likelihood of better patient outcomes.

It should also be appreciated that the novel leg holder 5 may be reconfigured as a limb holder to provide support for different limbs, e.g., it may be reconfigured to provide support for the arms of a patient.

The present invention may also be used in connection with patient supports other than surgical tables, e.g., it may be used with gurneys, hospital beds, chairs, etc., and the present invention may be used for procedures other than surgical procedures, e.g., it may be used for examination procedures, physical therapy, etc.

MODIFICATIONS OF THE PREFERRED EMBODIMENTS

It should be understood that many additional changes in the details, materials, steps and arrangements of parts, which have been herein described and illustrated in order to explain the nature of the present invention, may be made by those skilled in the art while still remaining within the principles and scope of the invention.

What is claimed is:

1. A limb holder comprising:

a mounting bracket for attachment to a surgical table;

a mounting element comprising a first semi-spherical surface and a neck connecting said first semi-spherical surface to said mounting bracket, said neck defining a longitudinal axis of said mounting element;

a clamping assembly for providing a clamping engagement about said first semi-spherical surface of said mounting element, said clamping assembly comprising an upper jaw comprising a second semi-spherical surface and a lower jaw comprising a third semi-spherical surface, wherein said upper jaw and said lower jaw are biased towards one another so as to provide said clamping engagement by engagement of said second semi-spherical surface and said third semi-spherical surface about said first semi-spherical surface of said mounting element, wherein said clamping assembly is configured to rotate around said mounting element along three axes of rotation;

an upper limiting pin and a lower limiting pin which extend along said neck and cooperate with an upper limit surface on said upper jaw and a lower limit surface on said lower jaw to limit movement of said upper and lower jaws about the first semi-spherical surface of said mounting element;

a limb support element mounted to said clamping assembly via a support rod; and a release mechanism mounted to said support rod and connected to said clamping assembly for selectively releasing said clamping engagement of said clamping assembly about said first semi-spherical surface of said mounting element, whereby to allow said limb support element to be repositioned relative to said mounting element and hence repositioned relative to the surgical table.

2. The limb holder according to claim 1 wherein the limb holder is configured to hold a leg of a patient.

3. The limb holder according to claim 2 wherein said limb support element comprises a stirrup boot.

4. The limb holder according to claim 1 wherein the first semi-spherical surface comprises a semi-ball.

5. The limb holder according to claim 1 wherein said clamping assembly comprises a spring for biasing said upper jaw toward said lower jaw, whereby to provide said clamping engagement about said first semi-spherical surface of said mounting element.

6. The limb holder according to claim 5 wherein said release mechanism comprises a cam mechanism for forcing said lower jaw away from said upper jaw, against the bias of said spring, whereby to allow said upper jaw and said lower jaw to rotate about said mounting element.

7. The limb holder according to claim 6 wherein said release mechanism comprises an actuating mechanism for actuating said cam mechanism.

8. The limb holder according to claim 7 wherein said actuating mechanism comprises a handle and trigger mounted to said support rod.

9. The limb holder according to claim 1 further comprising a gas cylinder extending between said mounting bracket and said support rod.

* * * * *